US007448436B2

(12) United States Patent
Katoh et al.

(10) Patent No.: US 7,448,436 B2
(45) Date of Patent: Nov. 11, 2008

(54) HEAT EXCHANGER

(75) Inventors: Yoshiki Katoh, Chita-gun (JP); Masaaki Kawakubo, Obu (JP); Etsuo Hasegawa, Nagoya (JP); Ken Muto, Toyota (JP)

(73) Assignee: DENSO CORPORATION, Kariya (JP)

( * ) Notice: Subject to any disclaimer, the term of this patent is extended or adjusted under 35 U.S.C. 154(b) by 512 days.

(21) Appl. No.: 10/827,559

(22) Filed: Apr. 19, 2004

(65) Prior Publication Data

US 2004/0206490 A1 Oct. 21, 2004

(30) Foreign Application Priority Data

Apr. 21, 2003 (JP) ..... 2003-116198
Dec. 26, 2003 (JP) ..... 2003-434216
Feb. 18, 2004 (JP) ..... 2004-041453

(51) Int. Cl.
*F25B 39/02* (2006.01)

(52) U.S. Cl. ..... 165/61; 165/110; 165/144; 165/145; 165/152; 165/153; 165/176; 165/178; 62/525; 62/526

(58) Field of Classification Search ..... 165/110, 165/111, 112, 113, 176, 61, 41, 152, 153, 165/144, 145, 178; 62/525, 526
See application file for complete search history.

(56) References Cited

U.S. PATENT DOCUMENTS 2,587,720 A * 3/1952 Fritzberg ..... 165/110
4,417,619 A * 11/1983 Minami ..... 165/113
5,157,944 A 10/1992 Hughes et al.
5,251,692 A * 10/1993 Haussmann ..... 165/152
RE35,502 E 5/1997 Hughes et al.
5,634,349 A 6/1997 Kakehashi et al.

(Continued)

FOREIGN PATENT DOCUMENTS

EP 0 683 373 11/1995

(Continued)

OTHER PUBLICATIONS

Office Action dated Sep. 18, 2007 from corresponding JP Application No. 2004-041453 (with translation).

(Continued)

*Primary Examiner*—John K Ford
(74) *Attorney, Agent, or Firm*—Harness, Dickey & Pierce, PLC

(57) ABSTRACT

In a heat exchanger, a core has a first core portion including first tubes and a second core portion including second tubes. The first tubes defines first passages through which an internal fluid flows and the second tubes defines second passages through which the internal fluid passed through the first passages flows. A flow direction of the internal fluid passed through a first section of the first core portion and a flow direction of the refrigerant passed through a second section of the first core portion are changed with respect to a direction that the tubes are layered, before flowing in the second core portion. Thus, the internal fluid passed through the first section of the first core portion flows into a second section of the second core portion and the internal fluid passed through the second section of the first core portion flows into a first section of the second core portion.

24 Claims, 20 Drawing Sheets

U.S. PATENT DOCUMENTS

| | | | |
|---|---|---|---|
| 6,272,881 | B1 | 8/2001 | Kuroyanagi et al. |
| 6,339,937 | B1 | 1/2002 | Makihara et al. |
| 6,536,517 | B2 | 3/2003 | Hoshino et al. |
| 7,021,371 | B2 | 4/2006 | Saito et al. |
| 2002/0066553 | A1 | 6/2002 | Fischer et al. |

FOREIGN PATENT DOCUMENTS

| | | |
|---|---|---|
| EP | 0 769 665 | 4/1997 |
| EP | 0 802 383 | 10/1997 |
| JP | 59-63472 | 4/1984 |
| JP | 59-172966 | 11/1984 |
| JP | 60-076414 | 4/1985 |
| JP | 63-173673 | 11/1988 |
| JP | 63-198970 | 12/1988 |
| JP | 1-160231 | 11/1989 |
| JP | 08-075311 | 3/1996 |
| JP | 2001-12821 | 1/2001 |
| JP | 2001-147095 | 5/2001 |
| JP | 2001-289536 | 10/2001 |
| JP | 2004-044851 | 2/2004 |
| WO | WO 02/103263 | 12/2002 |

OTHER PUBLICATIONS

Search Report dated May 23, 2008 issued in the corresponding FR application No. 0404176.

* cited by examiner

| AIR VOLUME CONDITION (V) | TEMPERATURE DIFFERENCE (°C) | |
|---|---|---|
| | EMBODIMENT (e.g. FIG.7A) | COMPARISON (e.g. FIG.20A) |
| L6V-R6V | 1.1 | 1.4 |
| L7V-R5V | 1.1 | 0.9 |
| L5V-R7V | 1.1 | 3.8 |
| L8V-R4V | 1.0 | 2.4 |
| L4V-R8V | 1.2 | 7.8 |
| L10V-R2V | 2.2 | 24.2 |
| L2V-R10V | 1.6 | 22.7 |
| L12V-R0V | 3.3 | 26.2 |
| L0V-R12V | 5.3 | 25.6 |

HEAT EXCHANGER

CROSS REFERENCE TO RELATED APPLICATION

This application is based on Japanese Patent Applications No. 2003-116198 filed on Apr. 21, 2003, No. 2003-434216 filed on Dec. 26, 2003 and No. 2004-41453 filed on Feb. 18, 2004, the disclosures of which are incorporated herein by reference.

FIELD OF THE INVENTION

The present invention relates to a heat exchanger. Particularly, the present invention relates to a refrigerant evaporator suitably used in a refrigerating cycle of a vehicle air conditioning apparatus and relates to a heat exchanger used in a heat pump cycle system.

BACKGROUND OF THE INVENTION

As examples of a refrigerant evaporator, a multi-flow type heat exchanger and a serpentine flow-type heat exchanger are known in U.S. Pat. No. 6,339,937 (Unexamined Japanese Patent Publication No. JP-A-2001-324290) and Un examined Japanese Patent Publication JP-A-2001-12821. In the multi-flow type heat exchanger, a core portion having a plurality of tubes is arranged between an upper and lower tanks. It is constructed such that a refrigerant flows in the plural tubes at the same time. In the serpentine flow-type heat exchanger, the refrigerant flows in a similar manner.

In the core portion, the tubes are arranged in a direction perpendicular to a flow direction A of air passing outside of the heat exchanger. Hereafter, a direction in which the tubes are arranged is referred to as a core width direction D1 or a right and left direction of the heat exchanger. A downstream side of the core portion with respect to the sir flow direction A is referred to as a front side and an upstream side of the core portion with respect to the air flow direction A is referred to as a rear side.

For example, in a refrigerant evaporator shown in FIG. 19, a plurality of flat tubes 120 are layered between an upper tank 116 and a lower tank 118. The tubes 120 forms a core portion 122. A refrigerant inlet connector 112 and are frigerant outlet connector 114 are connected to a left end and a right end of the upper tank 116. A separator 124 is provided in a middle portion of the upper tank 116. The refrigerant flows in the left tubes 120, which are arranged in a left section of the core portion 122, at the substantially same time and makes a turn in the lower tank 118 from the left side to the right side. Then, the refrigerant flows in the right tubes 120, which are arranged in a right section of the core portion 122. Thus, a refrigerant first pass P1 is made in the left section and a refrigerant second pass P2 is made in the right section, when viewed in a broad aspect. Here, even if the refrigerant evaporator is placed such that the upper tank 116 and the lower tank 118 extend vertically and the tubes 120 are layered in a vertical direction, the direction that the tubes 120 are layered is still referred to as the core width direction D1.

In the above left-right U-turn type evaporator, if the refrigerant has super heat, temperature distribution is likely to be generated in the right section of the core portion 122 in which the second refrigerant pass P2 is made. As a result, temperature of air blown from the left section and the right section will be uneven.

Also in a case that the refrigerant does not have super heat, it is necessary to uniformly distribute the liquid refrigerant in the right tubes 120 because the amount of the refrigerant is generally small. If the refrigerant is not uniformly distributed in the tubes 120, the refrigerant will be dried out, that is, completely evaporated in the tubes 120 in which the amount of the refrigerant is small. As a result, the temperature of air is not uniform.

To solve this problem, a 2-2 pass-type evaporator shown in FIGS. 20A, 20B is proposed. It is for example disclosed in U.S. Pat. No. 6,272,881B1 (JP-A-11-287587). In the 2-2 pass-type evaporator, a front core portion 122A and a rear core portion 122B are arranged between a pair of upper tanks 116A, 116B and a pair of lower tanks 118A, 118B. A refrigerant inlet and outlet connector 113 is connected to a upper left end of the upper tanks 116A, 116B. A separator 124A is provided in the upper front tank 116A, which communicates with the refrigerant inlet and a separator 124B is provided in the upper rear tank 116B, which communicates with the refrigerant outlet. Thus, two refrigerant passes P1 and P2 are made in the front core portion 122A and two refrigerant passes P3 and P4 are made in the rear core portion 122B, from a broad view. As shown in FIG. 20B, the front core portion 122A is constructed of a row of tubes 120A and the rear core portion 122B is constructed of a row of tubes 120B. Corrugated fins 126 are interposed between the tubes 120A, 120B.

In the above evaporator, since the refrigerant flows through four passes P1 to P4, the flow distance of the refrigerant is long. Also, the refrigerant turns many times. That is, the numbers that the refrigerant flows in and out the tubes 120A, 120B and the core portions 122A, 122B is increased (four times in FIG. 20A). Therefore, the pressure loss of the refrigerant is increased throughout the evaporator. As a result, the performance of the evaporator is deteriorated.

To solve this problem, a front and rear U-turn type evaporator is proposed, as shown in FIG. 21. In the evaporator, separators are not provided in the tanks 116A, 116B. Thus, the refrigerant flows in all front tubes 120 in the front core portion 122A and makes turn from the front side to the rear side in the lower tanks 118A, 118B. Then, the refrigerant flows in the rear tubes 120 of the rear core portion 122B. This kind of evaporator is for example disclosed in Unexamined Japanese Publication No. JP-A-2003-75024 (WO02103263). In this evaporator, the pressure loss is likely to be reduced and the temperature difference of air is likely to be reduced.

Recently, in the vehicle air conditioning apparatus, it is required to independently control the temperature of air between a right region and a left region of a passenger compartment. Therefore, it is difficult to adapt the above evaporator to such vehicle air conditioning apparatus.

In the above evaporator, in a core section through which a large amount of air flows, heat exchange is performed between air and the refrigerant and the air is cooled. Because an amount of the refrigerant evaporation is large, the pressure loss is increased with an increase in the air volume. On the other hand, in a core section in which an air flow amount is small, the amount of the refrigerant evaporation is small. Therefore, the increase in the air volume is small and the pressure loss is not increased greatly. As a result, in the full pass-type evaporator shown in FIG. 21, the refrigerant easily flows in the core section where the volume of air passing therethrough is small, that is, the core section where the pressure loss of the refrigerant is small. Therefore, it is difficult to maintain cooling performance at the core section where high cooling performance is more required, that is, the core section where the air volume is large. Also, in the large air section, the refrigerant easily has the super heat and is dried out. Therefore, it is difficult to uniform the temperature of air.

SUMMARY OF THE INVENTION

The present invention is made in view of the foregoing matter and it is an object of the present invention to provide a heat exchanger, which is capable of reducing pressure loss in a flow of an internal fluid and being uniform temperature distribution in a core portion with respect to a core width direction.

According to a first aspect of the present invention, a heat exchanger has a core portion, an introducing portion, a discharging portion, a collecting portion, and a distributing portion. In the core portion, a plurality of tubes is arranged in at least one row. The tubes define first passages through which an internal fluid flows and second passages through which the internal fluid flows after passed through the first passages. The introducing portion and the discharging portion are connected to the core portion. The internal fluid flows in the introducing portion and discharges from the discharging portion after passed through the core portion. The collecting portion and the distributing portion are connected to the core portion. The collecting portion forms a first space communicating with the first passages in a first section of the core portion and a second space communicating with the first passages in a second section of the core portion. The distributing portion forms a first space communicating with the second passages in the first section of the core portion and a second space communicating with the second passages in the second section of the core portion. Further, the distributing portion communicates with the collecting portion through a communication part. The communication part includes a first communicating portion and a second communicating portion. The first communicating portion is disposed to allow communication between the first space of the collecting portion and the second space of the distributing portion. The second communicating portion is disposed to allow communication between the second space of the collecting portion and the first space of the distributing portion.

Accordingly, the internal fluid having passed through the first passages in the tubes in the first section of the core portion flows in the first space of the collecting portion and then flows in the second space of the distributing portion through the first communicating portion. Then, the internal fluid flows in the second passages in the tubes in the second section of the core portion. On the other hand, the internal fluid having passed through the first passages in the tubes in the second section of the core portion flows in the second space of the collecting portion and further flows in the first space of the distributing portion through the second communicating portion. Then, the internal fluid flows in the second passages in the first section of the core portion. Therefore, the flows of the internal fluid are intersected through the communicating member, between the first section and the second section of the core portion. That is, the flow direction of the internal fluid are changed with respect to a core width direction that the tubes are arranged. Accordingly, the amount of internal fluid evaporation is uniform throughout the core portion. With this, the temperature of an external fluid passing through the core portion is uniform with respect to the core width direction. Because the number of turns of the internal fluid flow is small, for example, two, pressure loss of the internal fluid is reduced. Preferably, the heat exchanger is used as a refrigerant evaporator in a system in which volumes of the external fluid applied to the first section and the second section of the core portion are different, for example in a vehicle air conditioning system for independently controlling a left region and a right region of a compartment, because the temperature difference of the external fluid is small.

In a case that the tubes are arranged in two rows, the first passages are defined in a first row of tubes and the second passages are defined in a second row of tubes. Preferably, the first and second communicating portions can be disposed to cross each other with respect to the core width direction. Alternatively, the first communicating portion and the second communicating portion can be disposed at a first end and a second end of the collecting portion, respectively. In this case, the collecting portion and the distributing portion can be provided of tank portions. The tank portions can be formed by joining a tank plate forming grooves and a communication plate forming communication holes. Accordingly, the tank portions can be easily formed.

According to a second aspect of the present invention, the heat exchanger has a core portion, an introducing portion, a discharging portion, a first tank portion and a second tank portion. In the core portion, a plurality of first tubes defining first passages and second tubes defining second passages are alternately arranged in a row. The first tank portion and the second tank portion are connected to the core portion. The first tank portion forms first inflow holes to allow communication between the first tubes in a first section of the core portion and the first tank portion. Also, the first tank portion forms first outflow holes to allow communication between the first tank portion and the second tubes in a second section of the core portion. The second tank portion forms second inflow holes to allow communication between the first tubes in the second section of the core portion and the second tank portion. Also, the second tank portion forms second outflow holes to allow communication between the second tank portion and the second tubes in the first section of the core portion.

Since the first tubes and second tubes are alternately arranged in the single row, the temperature distribution is uniform. The first tubes and second tubes can be arranged such that a set of first tubes and a set of second tubes are arranged alternately in the single row. Each set of the tubes includes a predetermined number of tubes.

BRIEF DESCRIPTION OF THE DRAWINGS

Other objects, features and advantages of the present invention will become more apparent from the following detailed description made with reference to the accompanying drawings, in which like parts are designated by like reference numbers and in which.

DETAILED DESCRIPTION OF EMBODIMENTS

Figure 1A:
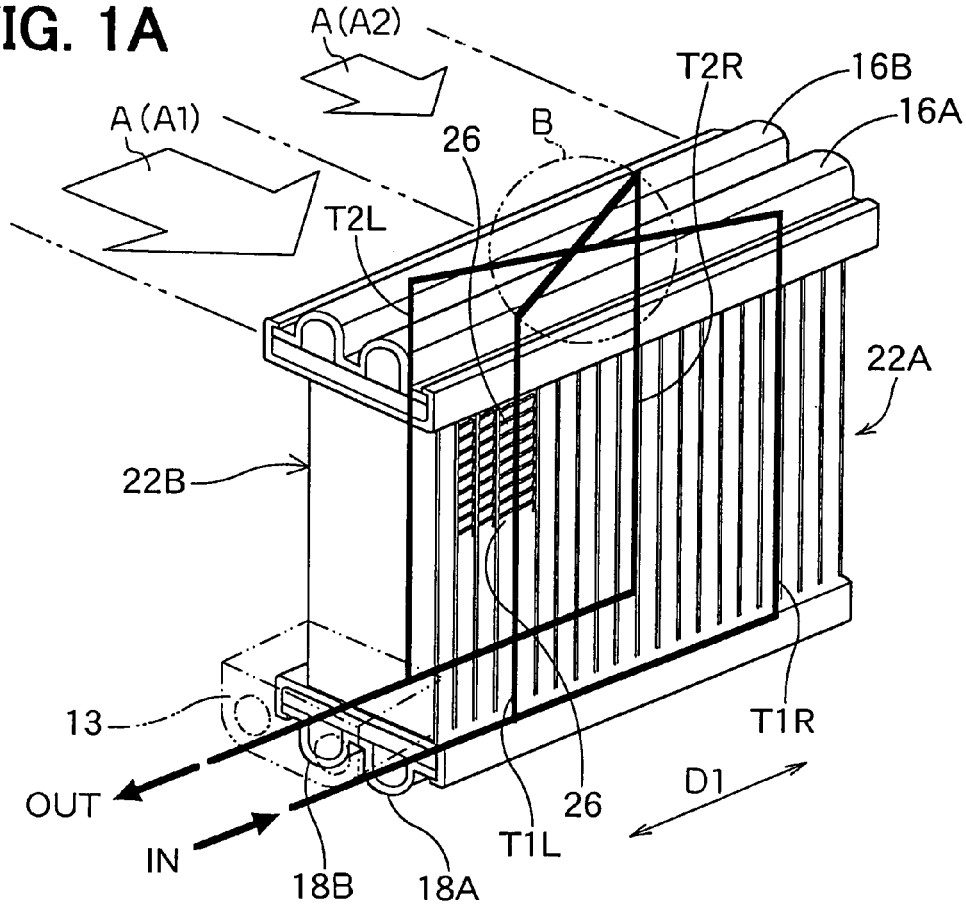
FIG. 1A is a perspective view of a refrigerant evaporator according to a first embodiment of the present invention.

Embodiments of the present invention will be described hereinafter with reference to the drawings. In the embodiment, a heat exchanger is for example applied to a front-rear U-turn type refrigerant evaporator performing heat exchange between an external fluid (air) and an internal fluid (refrigerant). The present invention is not limited to this type of refrigerant evaporator.

Throughout the specification, a direction in which a plurality of tubes of a core portion of the evaporator is layered is referred to as a core width direction D1. In the evaporator, a side located downstream with respect to an air flow direction is referred to as a front side of the evaporator and a side located upstream with respect to the air flow direction is referred to as a rear side of the evaporator. Pass T1, T2 denote flows of the refrigerant in the evaporator, from a broad view. In the drawings, an arrow A (A1, A2) denote an air flow direction.

Figure 1B:
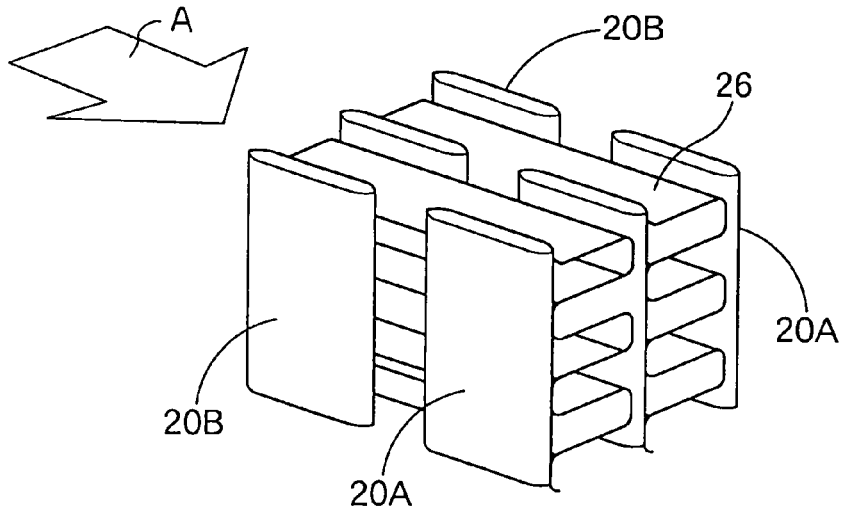
FIG. 1B is a perspective view of a part of the refrigerant evaporator shown in FIG. 1A for showing arrangement of tubes and fins.
Figure 2:
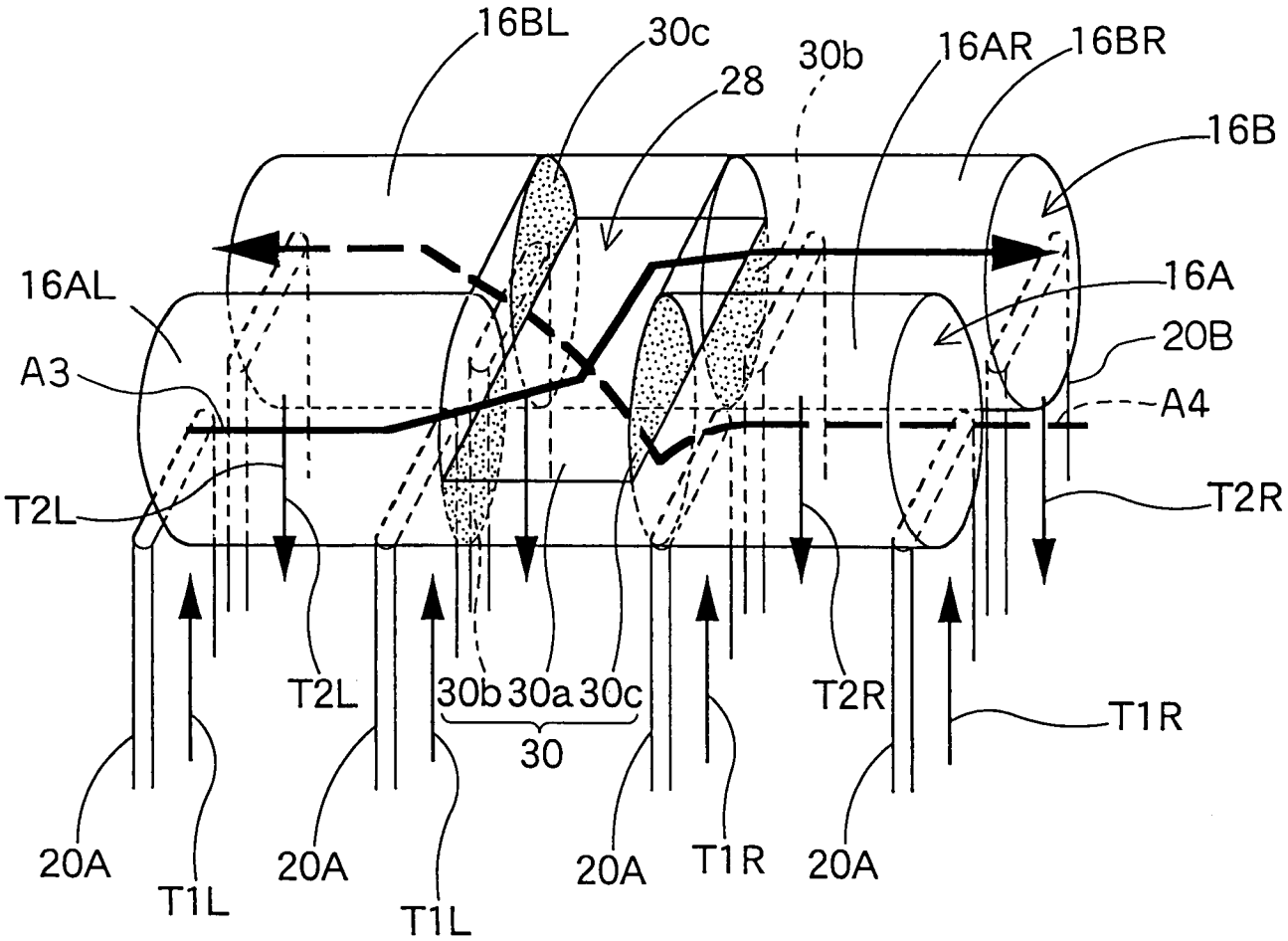
FIG. 2 is an enlarged perspective view of an intersectional portion of the refrigerant evaporator according to the first embodiment of the present invention.

Referring to FIGS. 1A, 1B and 2, the evaporator is multi-flow-type (MF-type) and is constructed of an upper front tank portion (refrigerant collecting portion) 16A, an upper rear tank portion (refrigerant distributing portion) 16B, a lower front tank portion (refrigerant introducing portion) 18A, a lower rear tank portion (refrigerant discharging portion) 18B, a front core portion 22A, and a rear core portion 22B. The core portions 22A, 22B are arranged between the upper tank portions 16A, 16B and the lower tank portions 18A, 18B. The front core portion 22A is constructed of a front row (first row) of tubes 20A. The rear core portion 22B is constructed of a rear row (second row) of tubes 20B.

A connector 13, which has a refrigerant inlet and a refrigerant outlet therein, is connected to the lower tank portions 18A, 18B. The refrigerant inlet communicates with the lower front tank portion 18A and the refrigerant inlet communicates with the lower rear tank portion 18B. Further, as shown in FIG. 1B, heat-absorbing fins, such as corrugate fins, 26 are interposed between the front tubes 20A and the rear tubes 20B through the front side to the rear side.

As shown by a solid line in FIG. 1A, a first refrigerant pass T1 is made in the front tubes 20A of the front core portion 22A in an upward direction. The flow direction of the refrigerant is perpendicular to the air flow direction A in the core portion and is opposed to the air flow direction A in the tank portions 16A, 16B. This configuration is advantageous in view of performance and temperature distribution. Further, in the case where the first pass T1 is made in the front core portion 22A in the upward direction, distribution of the refrigerant into the respective tubes 20A is improved. This contributes to uniform temperature distribution in the core portion.

Alternatively, the connector 13 can be connected to the upper tanks 16A, 16B and the first pass T1 can be made in the downward direction. Also, the first pass T1 can be made in the rear tubes 22B of the rear core portion 22B.

In this front and rear U-turn evaporator, the flow direction of the refrigerant after the first pass T1 is changed with respect to the core width direction D1 in the upper tank portions 16A, 16B while making U-turn from the front side to the rear side. Hereafter, it is described based on a case in which the flow direction of the refrigerant are changed with respect to all the tubes 20A. Alternatively, the change of the flow direction can be partly performed with respect to the refrigerant flowing in some tubes 20A. This case can also provide similar advantage.

The flow of the refrigerant in the evaporator will be described more in detail. As shown in FIG. 1A, the refrigerant flowed in the lower front tank portion 18A flows in the front tubes 20A. In the upper tank portions 16A, 16B, the refrigerant passed through the front tubes 20A in a left section of the front core portion 22A (left first pass T1L) flows toward a right side and flows in the rear tubes 20B in a right section of the rear core portion 22B (right second pass T2R). On the other hand, the refrigerant passed through the front tubes 20A in the right section of the front core portion 22A (right first pass T1R) flows toward the left side and flows in the rear tubes 20B in the left section of the rear core portion 22A (left second pass T2L).

Thus, in the upper tank 16A, 16B, the flows of the refrigerant horizontally cross each other with respect to the core width direction D1 through an intersectional part (communication part), as shown in a double-broken circle line B. That is, the refrigerant passed through the left first pass T1L flows in a left portion 16AL of the upper front tank 16A. The refrigerant further flows toward a right portion 16BR of the upper rear tank 16B, then makes the right second pass T2R. Similarly, the refrigerant passed through the right first pass T1R flows in a right portion 16AR of the upper front tank 16A. Then, the refrigerant flows toward a left portion 16BL of the upper rear tank 16B, then makes the left second pass T2L. The refrigerant passed through the second left and right passes T2L, T2R collects in the lower rear tank portion 18B and discharges from the refrigerant outlet of the connector 13.

The intersectional portion is constructed as shown in FIG. 2. The upper front tank 16A and the upper rear tank 16B are divided into the left portions 16AL, 16BL and the right portions 16AR, 16BL at the middle position thereof. A communication space 28 is formed at the middle portion of the upper front tank portion 16A and the upper rear tank portion 16B. A guide member (separator) 30 is fixed in the communication space 28. The guide member 30 has a separation wall portion 30*a* and two lower dam plates 30*b* and two upper dam plates 30*c*. The dam plates 30*b*, 30*c* have semicircular shapes. The lower dam plates 30*b* extend in the downward direction from the front left side and the rear right side of the separation wall portion 30*a*. The upper dam plates 30*c* extend in the upward direction from the front right side and the rear left side of the separation wall portion 30*a*.

Accordingly, the refrigerant passed through the left first pass T1L flows from the left upper front tank portion 16AL to the right upper rear tank portion 16BL through the upper space (communicating portion) of the communication space 28, as shown by a solid arrow A3 in FIG. 2. Then, the refrigerant passes through the right second pass T2R. On the other hand, the refrigerant passed through the right first pass T1R flows from the right upper front tank portion 16AR to the left upper rear tank portion 16BL through the lower space (communicating portion) of the communication space 28, as shown by a broken arrow A4 in FIG. 2. Then, the refrigerant passes through the left second pass T2L.

In FIG. 2, the refrigerant flow A3 from the left front portion 16AL to the right rear portion 16BR passes over the refrigerant flow A4 from the right front portion 16AR to the left rear portion 16BL. Alternatively, the intersectional portion can be formed such that the refrigerant flow A3 passes under the refrigerant flow A4.

In this evaporator configuration, the pressure loss of the refrigerant is reduced. Also, the temperature of air passing through the core portions 22A, 22B can be uniform with respect to the core width direction D1. When this evaporator is employed to a vehicle air conditioning apparatus, which independently controls air volumes between a right region and a left region of a passenger compartment, the comfortable air conditioning can be performed in both the right region and the left region.

Hereafter, an example that the air volumes are independently controlled between the right side and the left side of the core will be described with reference to FIG. 1A. Here, a volume of air Al applied to the left section of the core portion is larger than a volume of air A2 applied to the right section of the core portion. The air volumes A1, A2 are independently controlled by using blowers (not shown). Alternatively, the difference of the air volumes is created by providing a barrier wall at the air upstream or downstream position of the core portions 22A, 22B.

An amount of refrigerant evaporation in the first left pass T1L to which the air volume is large is larger than that in the second right pass T2R to which the air volume is small. On the other hand, an amount of refrigerant evaporation in the first right pass T1R to which the air volume is small is smaller than that in the second left pass T2L to which the air volume is large. As a result, the evaporating volume of the refrigerant is uniform throughout the core portion, although in the full-pass-type core. Accordingly, the sufficient temperature distribution is provided. Also, the performance is maintained at the large air volume side.

The configuration of the intersectional part to provide the refrigerant cross-flow before the second pass T2 is not limited to the above. The intersectional part can be provided in variable ways as follows.

Figure 3:
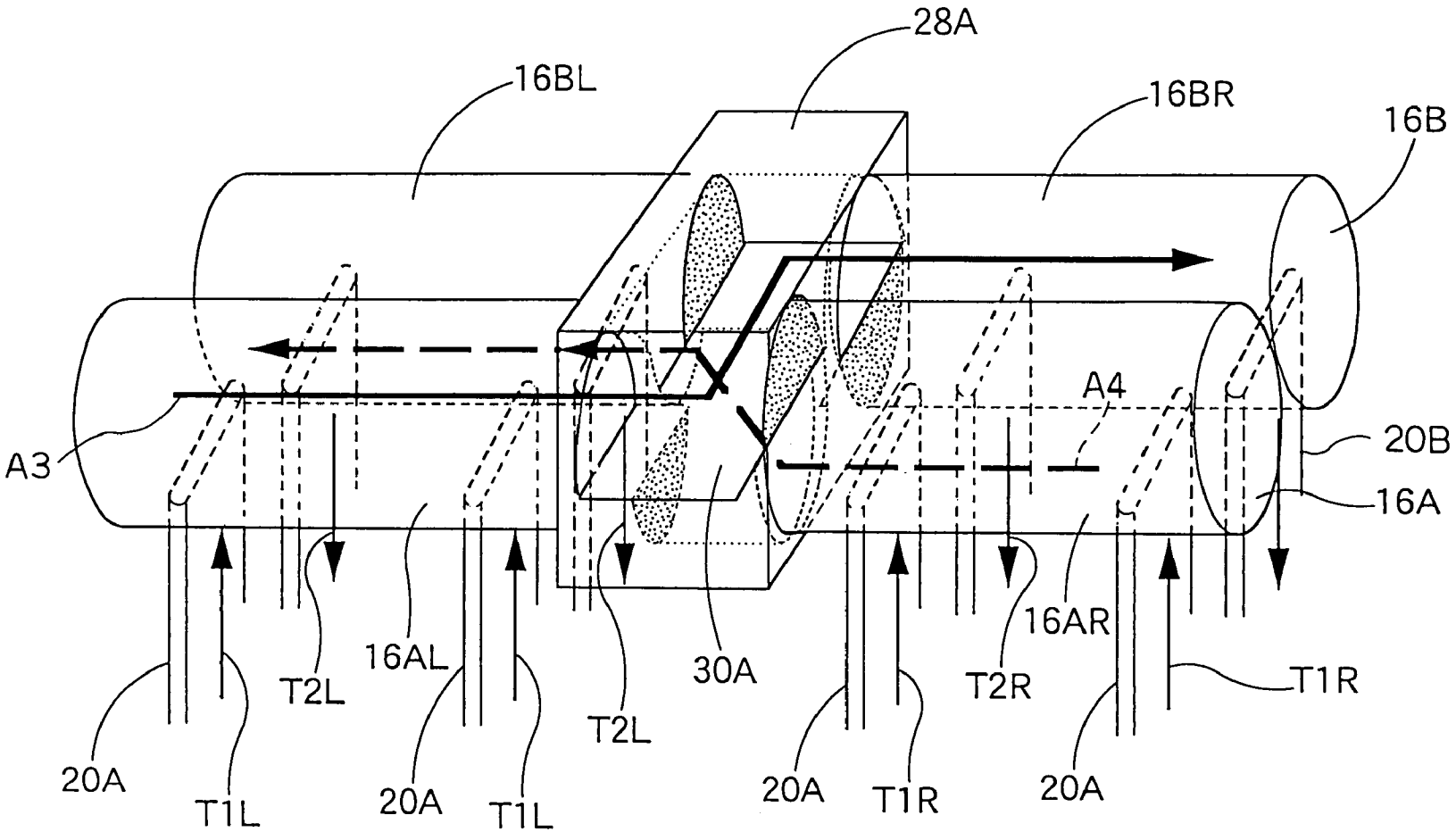
FIG. 3 is an enlarged perspective view of an intersectional portion of the refrigerant evaporator according to a second embodiment of the present invention.

In a second embodiment shown in FIG. 3, the intersectional part is provided by a connecting block 28A having a cross-flow guide portion 30A. By this, there frigerant cross-flow A3, A4 is provided in a manner similar to that of the first embodiment. Accordingly, similar advantages are provided.

Figure 4:
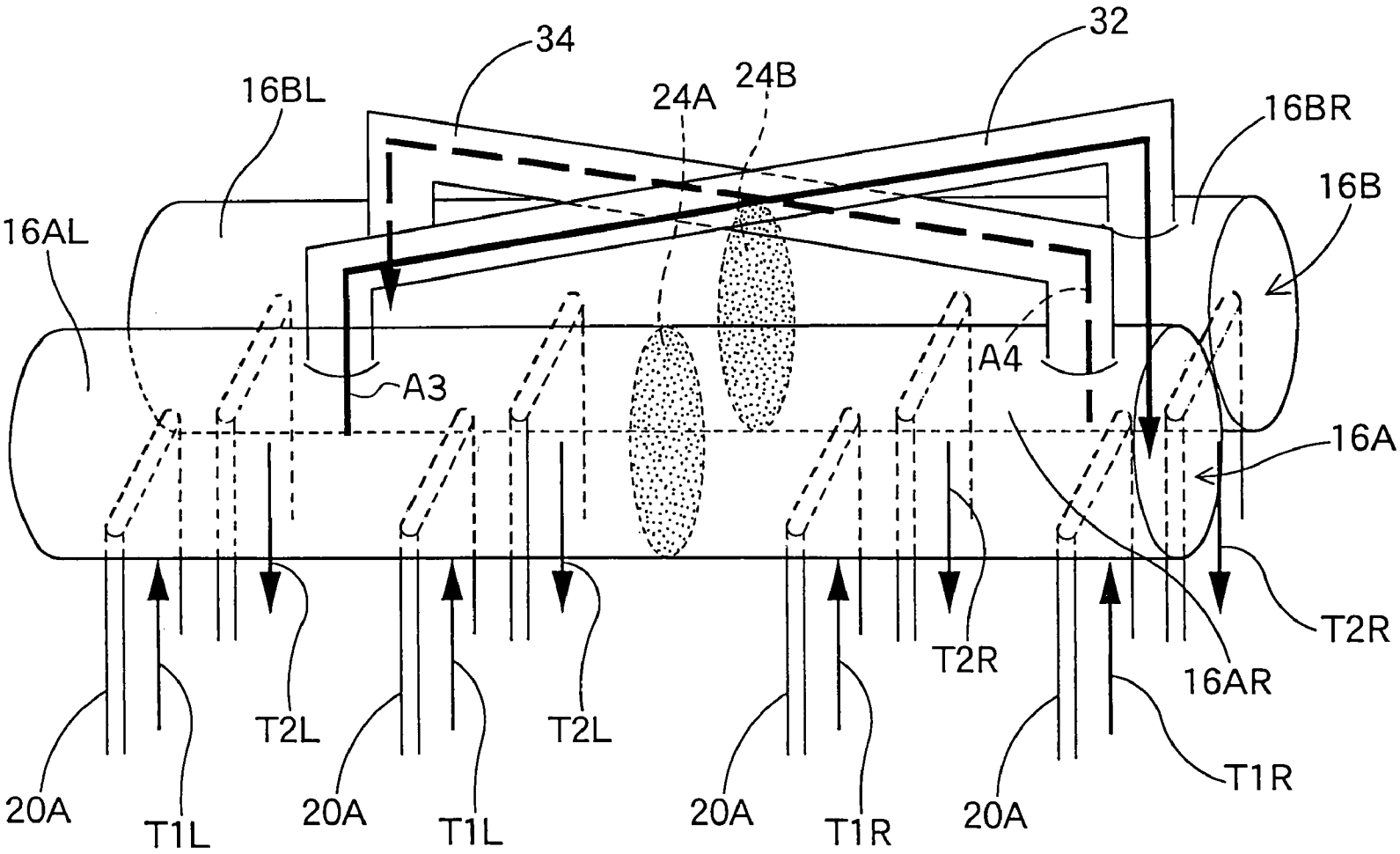
FIG. 4 is an enlarged perspective view of an intersectional portion of the refrigerant evaporator according to a third embodiment of the present invention.

In a third embodiment shown in FIG. 4, the intersectional part is provided a first communication pipe 32 and a second communication pipe 34 arranged outside of the upper tank portions 16A, 16B. A first separator 24A is provided in the upper front tank portion 16A and a second separator 24B is provided in the upper rear tank portion 16B. The first communication pipe 32 is provided to allow communication between the left upper front tank portion 16AL and the right upper rear tank portion 16BR. The second communication pipe 34 is provided to allow communication between the right upper front tank portion 16AR and the left upper rear tank portion 16BL. The first communication pipe 32 and the second communication pipe 34 are arranged to cross with each other. Similar to the first and second embodiments, the cross-flow of the refrigerant A3, A4 is formed. Accordingly, similar advantages can be provided.

Figure 5:
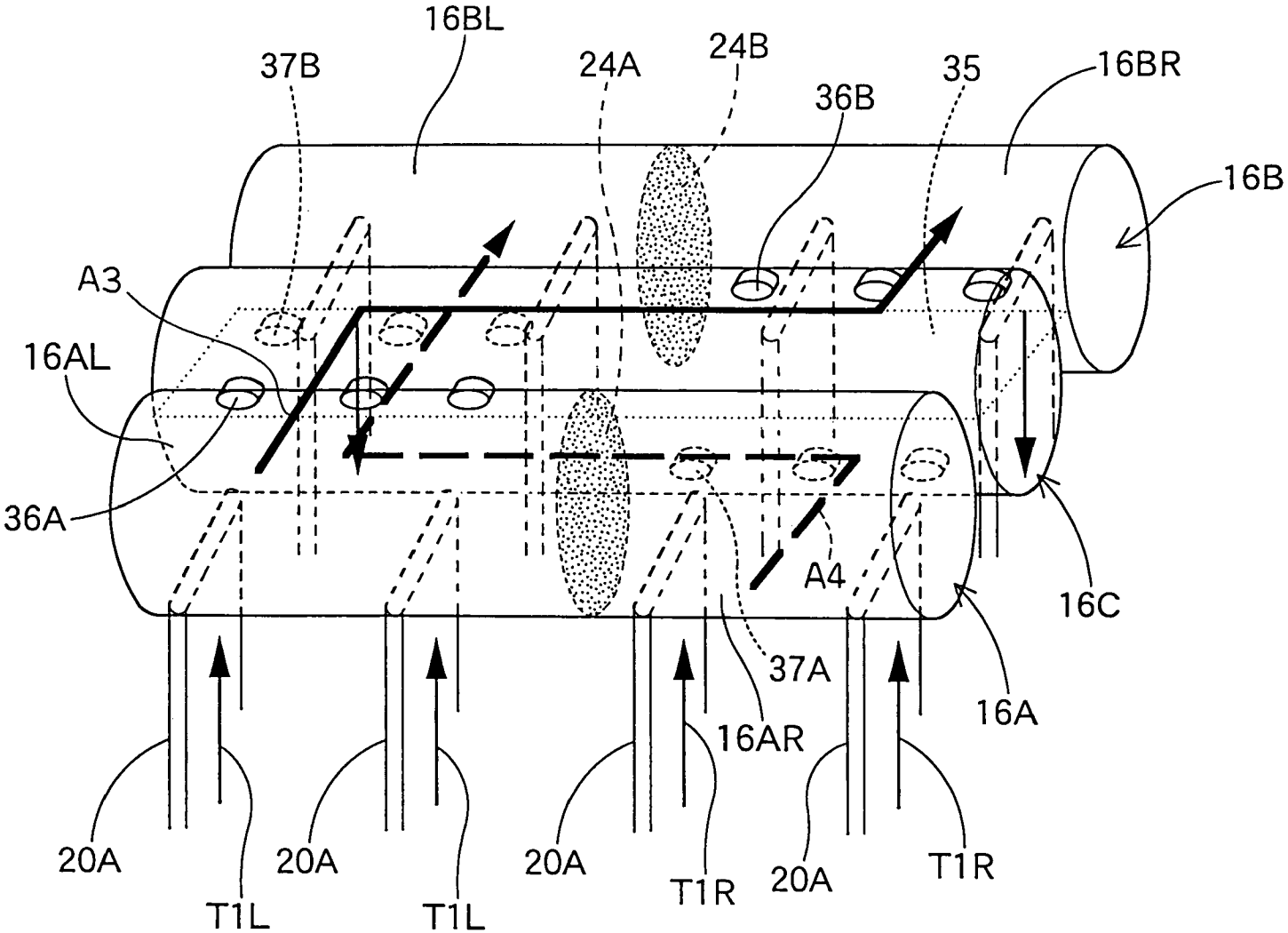
FIG. 5 is an enlarged perspective view of an intersectional portion of the refrigerant evaporator according to a fourth embodiment of the present invention.

In a fourth embodiment shown in FIG. 5, at least two refrigerant passage portions are provided between the upper front tank portion 16A and the upper rear tank portion 16B. The intersectional portion is provided by the refrigerant passage portions. Specifically, the first separator 24A and the second separator 24B are arranged in the upper front tank portion 16A and the upper rear tank portion 16B, in a manner similar to the fourth embodiment shown in FIG. 4. Further, a middle tank portion (connecting tank member) 16C is provided between the upper front tank portion 16A and the upper rear tank portion 16B to form the intersectional portion therein. A dividing wall 35 is provided inside the middle tank portion 16C to divide an inside space into an upper space and a lower space. In FIG. 5, the middle tank portion 16C has for example a cylindrical shape with a diameter same as the diameter of the upper front tank portion 16A and the upper rear tank portion 16B. The shape of the middle tank portion 16C is not limited to the cylindrical shape. For example, the middle tank 16C can have an arch-shaped cross-section or an oval-shaped cross-section projecting in the up and down direction.

Upper first communication holes 36A are formed to allow communication between the left upper front tank portion 16AL and the upper space of the middle tank portion 16C above the dividing wall 35. Similarly, upper second communication holes 36B are formed to allow communication between the right upper rear tank portion 16BR and the upper space of the middle tank portion 16C above the dividing wall 35. Thus, the refrigerant flowed in the left upper front tank portion 16AL after the left first pass T1L flows in the upper space of the middle tank portion 16C through the upper first communication holes 36A and then flows in the right upper rear tank portion 16BR through the second upper communication holes 36B. Then, the refrigerant flows through the right second pass T2R.

On the other hand, lower first communication holes 37A are formed to allow communication between the right front upper tank portion 16AR and the lower space of the middle tank portion 16C below the separation wall 35. Similarly, lower second communication holes 37B are formed to allow communication between the left upper rear tank portion 16BL and the lower space of the middle tank 16C below the separation wall 35. Thus, the refrigerant flowed in the right upper front tank portion 16AR after the right first pass T1R flows in the lower space of the middle tank portion 16C through the lower first communication holes 37A and then flows in the left upper rear tank portion 16BL through the second communication holes 37B. Then, the refrigerant passes through the left second pass T2L.

Accordingly, the refrigerant cross-flow A3, A4 is formed by the middle tank portion 16C. Advantages similar to the first to third embodiments can be provided in the fourth embodiment.

Figure 6A:
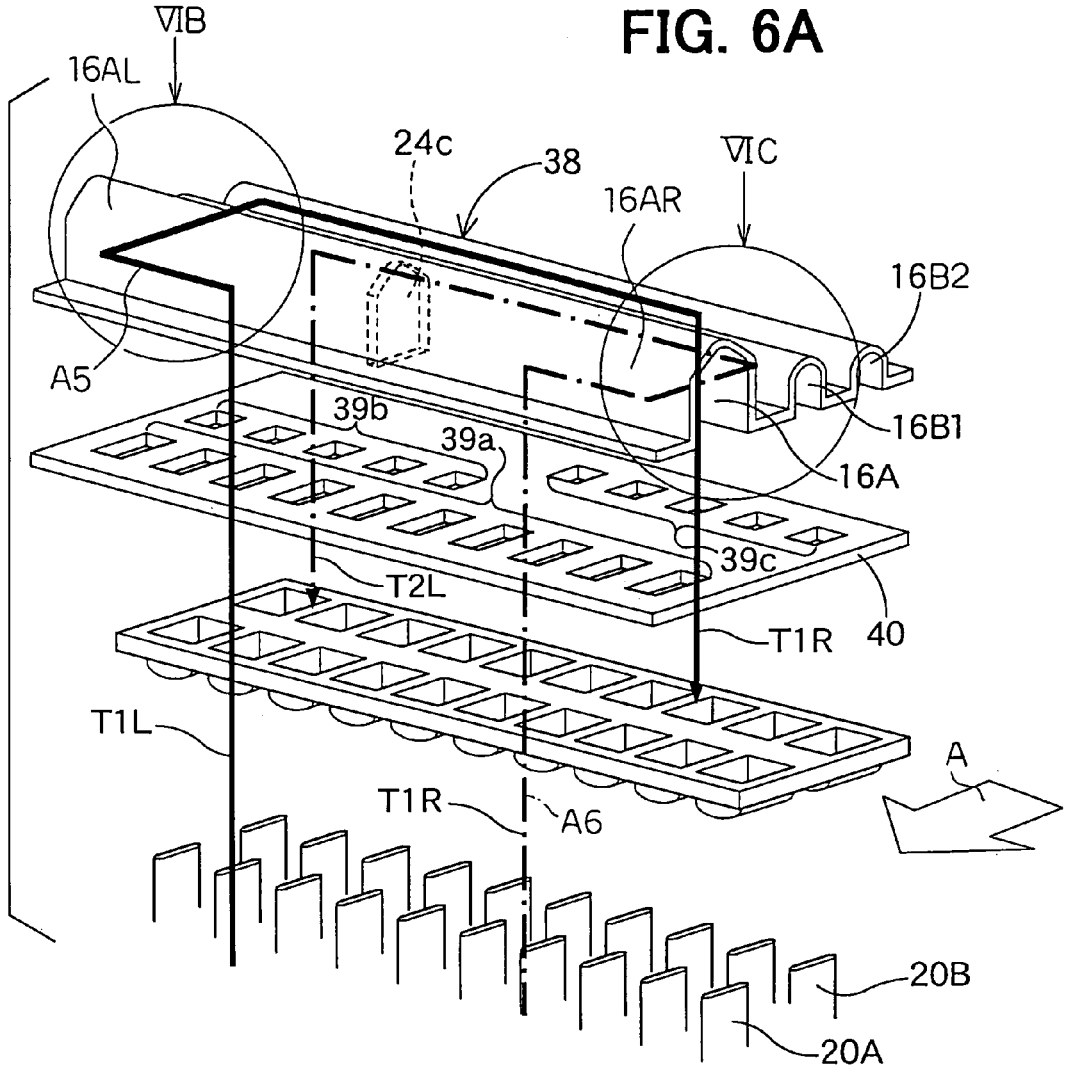
FIG. 6A is an exploded perspective view of the refrigerant evaporator according to a fifth embodiment of the present invention.
Figure 6B:
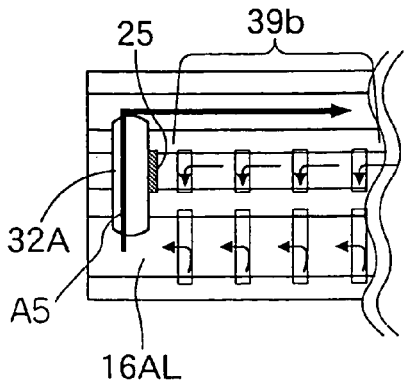
FIGS. 6B and 6C are explanatory view for explaining a flow of refrigerant in an upper tank of the refrigerant evaporator shown in FIG. 6A.
Figure 6C:
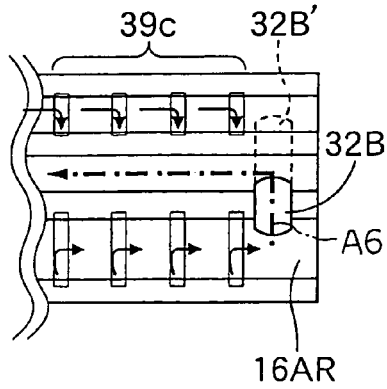

In a fifth embodiment shown in FIGS. 6A to 6C, the upper tank is formed of a tank plate 38 and a communication plate 40. The tank plate 38 forms three grooves 16A to 16C extending in the core width direction D1. A first groove 16A, which defines the upper front tank portion, is wider or larger than a second groove 16B1 and a third groove 16B2, which define an upper rear first tank portion 16B1 and a upper rear second tank portion 16B2. The communication plate 40 forms a group of front communication holes 39*a* on the front side corresponding to the upper front tank portion 16A, a group of rear first communication holes 39*b* on the rear left portion corresponding to the upper rear first tank portion 16B1, and a group of rear second communication holes 39*c* on the rear right portion corresponding to the upper rear second tank portion 16B2. Further, a separator 24C is provided in the upper front tank portion 16A at its middle position to divide the upper front tank portion 16A into the left upper front tank portion 16AL and the right upper front tank portion 16AR. The front communication holes 39*a* correspond to upper openings of the front tubes 20A of the front core 22A. The rear first communication holes 39*b* correspond to upper openings of the left rear tubes 20B of the rear core 22B. The second communication holes 39*c* correspond to the upper openings of the right rear tubes 20B of the rear core 22B.

Figure 6D:
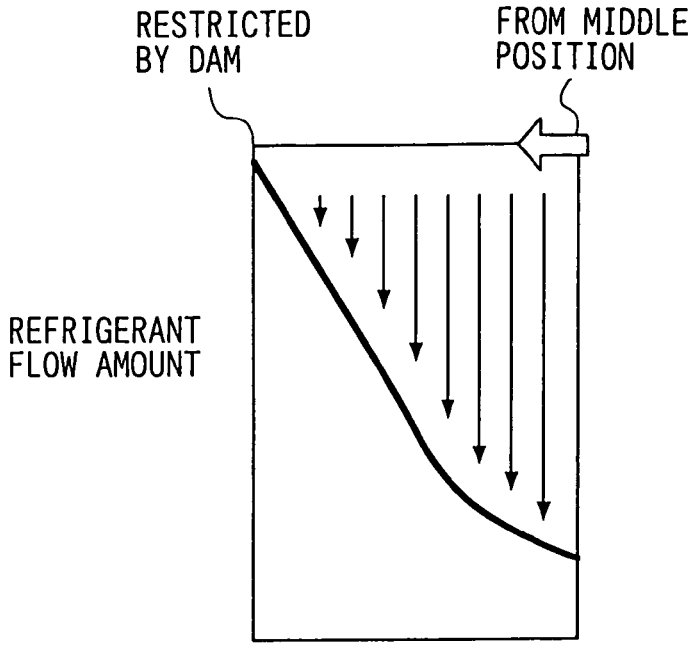
FIG. 6D is a graph for showing a distribution of the refrigerant when an entry of the refrigerant to a tank portion shown in FIGS. 6A to 6C is completely restricted by a dam.

As shown in FIG. 6B, a first communication passage (communicating portion) 32A is formed on the left end to allow communication between the left upper front tank portion 16AL and the upper rear second tank portion 16B2. As shown in FIG. 6C, a second communication passage (communicating portion) 32B is formed on the right end to allow communication between the right upper front tank portion 16AR and the upper rear first tank portion 16B1. The first communication passage 32A passes the upper rear first tank portion 16B1. Thus, a dam 25 is provided at a position corresponding to the upper rear first tank portion 16B1 to limit the refrigerant from flowing in the upper rear first tank portion 16B1 from the left end. It is not necessary that the dam 25 is provided to completely prohibit the entry of the refrigerant into the upper rear first tank portion 16B1. If the entry of the refrigerant is completely prohibited by the dam 25, the flow of the refrigerant from the middle portion of the upper rear first tank portion 16B1 toward the rear first communication holes 39*b* is not uniform as shown in FIG. 6D.

Figure 6E:
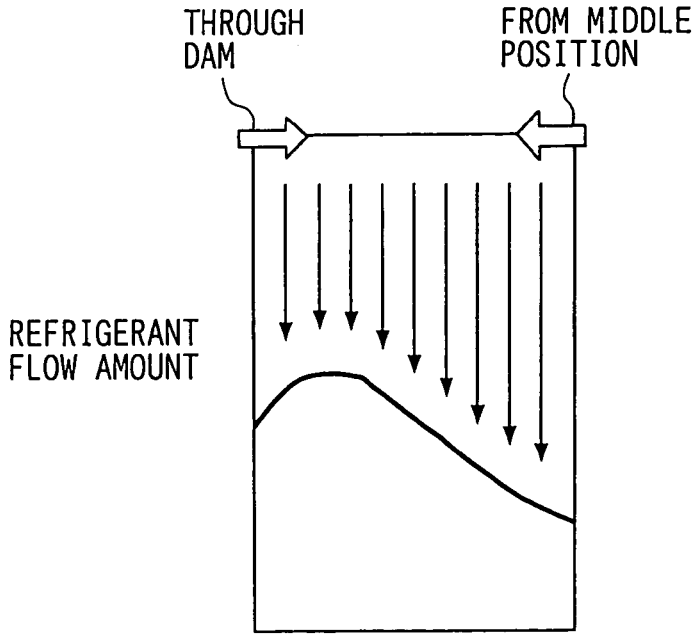
FIG. 6E is a graph for showing a distribution of the refrigerant when the entry of the refrigerant to the tank portion is limited by a dam according to the fifth embodiment of the present invention.

If the entry of the refrigerant through the dam 25 is allowed for some amount, the refrigerant flows in the upper rear first tank portion 16B1 from the left end through the dam 25 and from the middle portion of the upper rear first tank portion 16B1. That is, the refrigerant flows in the upper rear first tank portion 16B1 from both the sides. Thus, the flow of the refrigerant toward the rear first communication holes 39*b* is uniform, as shown in FIG. 6E. If the entry of the refrigerant through the dam 25 is large, the advantage of the present invention is likely to be reduced. Accordingly, it is preferable to control the open degree so that the amount of refrigerant allowed to enter is equal to or less than 30%.

In the fifth embodiment, the refrigerant flows in the evaporator as follows.

The refrigerant flowing through the left tubes 20A of the front core portion 22A flows in the left upper front tank portion 16AL, as shown by a solid arrow A5. Then, the refrigerant flows in the upper rear second tank portion 16B2 through the first communication passage 32A. Further, the refrigerant flows in the tubes 20B in the right section of the rear core portion 22B through the rear second communication holes 39*c* on the right section of the communication plate 40. Then, the refrigerant passes through the right second pass T2R.

On the other hand, the refrigerant flowing through the right tubes 20A of the front core 22A through the right first pass T1R flows in the right front upper tank portion 16AR, as shown by a broken arrow A6. Then, the refrigerant flows in the upper rear first tank portion 16B1 through the second communication passage 32B. Further, the refrigerant flows in the tubes 20B in the left section of the rear core portion 22B through the rear first communication holes 39*b* in the left section of the second tank plate 40. Then, the refrigerant passes through the left second pass T2L.

Alternatively, the second communication passage 32B can be elongated as shown by broken line 32B' in FIG. 6C so that the second communication passage 32B' has the same length as the first communication passage 32A of the left side. In this case, a dam is provided at the connecting portion between the second communication passage 32B and the upper rear second tank portion 16B2, in a manner similar to the dam 25 of the left end. Also in this case, the dam can be provided so that the entry of the refrigerant into the upper rear second tank portion 16B2 is not completely prohibited. The entry of the refrigerant can be allowed for some amount so that the refrigerant flows in the rear second communication holes 39*c* from the right end and the middle position. Thus, the flow of the refrigerant in the right rear tubes 20B is uniform.

Figure 7A:
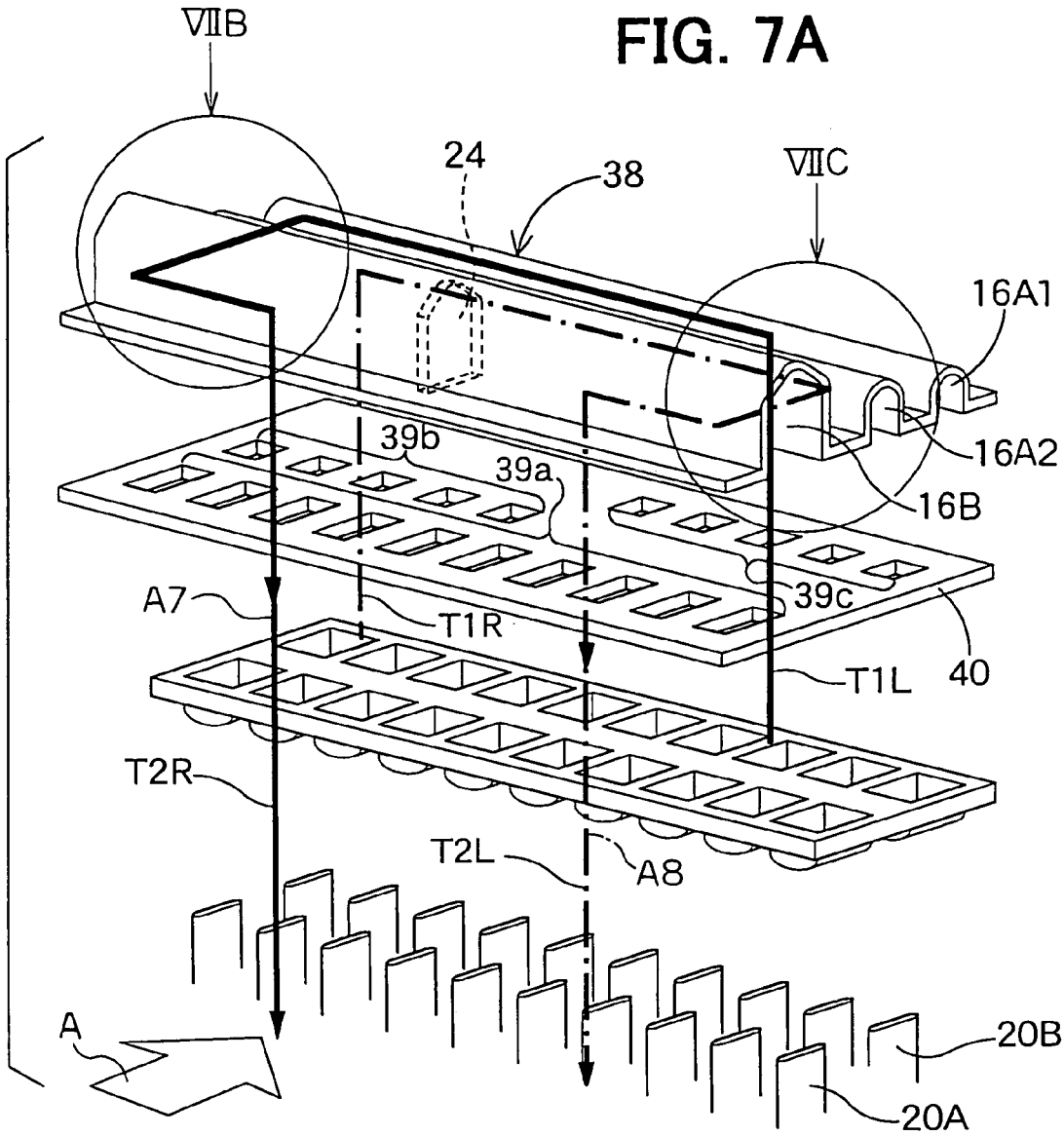
FIG. 7A is an exploded perspective view of the refrigerant evaporator in which the refrigerant flows in a direction opposite to the flow direction of FIG. 6A.
Figure 7B:
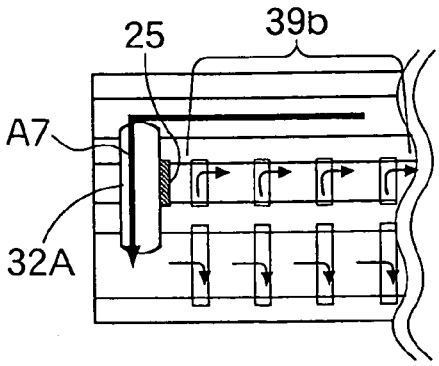
FIGS. 7B and 7C are explanatory view for explaining the flow of refrigerant in the upper tank shown in FIG. 7A.
Figure 7C:
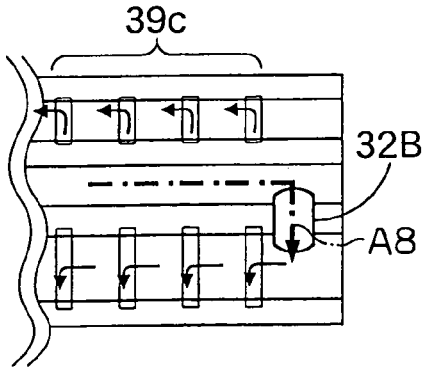

In a sixth embodiment shown in FIGS. 7A to 7C, the arrangement of the upper tank portion is opposite to the arrangement in FIGS. 6A to 6C with respect to the air flow direction A, and the flow direction of the refrigerant is also reversed, as denoted by arrows A7, A8. As shown in FIG. 7A, the wide groove 16B, which defines the upper rear tank portion, is formed on the air-upstream side in the tank plate 38 and two narrow grooves 16A1, 16A2, which defines the upper front first tank portion and the upper front second tank portion, are formed on the air-downstream side in the tank plate 38. The first row of tubes 20A that communicate with the wide tank portion 16B constructs a rear core portion 22B. The refrigerant second pass T2R, T2L are made in the tubes 20A.

The refrigerant passed through the first pass T1L and T1R in the tubes 20B flows in the narrow tank portions 16A1, 16A2, respectively, through the communication holes 39*c*, 39*b*. Then, the refrigerant flows in the wide tank portion 16B through the communication passages 32A, 32B formed on the left end and the right end. Further, the refrigerant flows in the tubes 20A of the rear core portion 22B. Thus, the refrigerant makes the second passes T2L and T2R in the tubes 20A arranged on the air upstream side. In this case, it is not always necessary to provide the separator 24C in the middle portion of the wide tank potion 16B. Alternatively, restrictor or throttle can be provided in the middle of the wide tank portion 16B.

The pressure loss and the air temperature difference in the evaporator shown in FIG. 7A is compared with a comparison evaporator. As the comparison evaporators, a 2-2 pass-type evaporator shown in FIGS. 20A, 20B and a front and rear U-turn type evaporator shown in FIG. 21 are used.

The evaporator in FIG. 7A and the comparison evaporators have the same core size. A core width is 285.3 mm. A core height is 235.0 mm. A core thickness is 38.0 mm.

Air is uniformly applied to the core. Here, conditions of air and refrigerant are controlled as follows. The air temperature is 40° C. and a relative humidity is 40%. Regarding the refrigerant, a pressure and a temperature at a position upstream of an expansion valve is 9.0 MPa and 27.92° C. A pressure and a heating degree at a position downstream of the evaporator is 4.0 MPa and 1.0° C.

<Pressure Loss Test>

Under the above test conditions, the air volumes are set to five points. The test results are shown in a graph of FIG. 8A. In the graph, a horizontal axis represents a flow rate GR (kg/h) of the refrigerant and a vertical axis represents a pressure loss ΔPr (MPa) of the refrigerant. Solid line R1 with square marks represents the result of the evaporator of the embodiment shown in FIG. 7A. Broken line R2 with round marks represents the result of the comparison evaporator shown in FIG. 20A. According to the test results, the pressure loss is reduced approximately 27% in the evaporator of the embodiment.

<Temperature Difference Test>

Figures 8A, 8B:
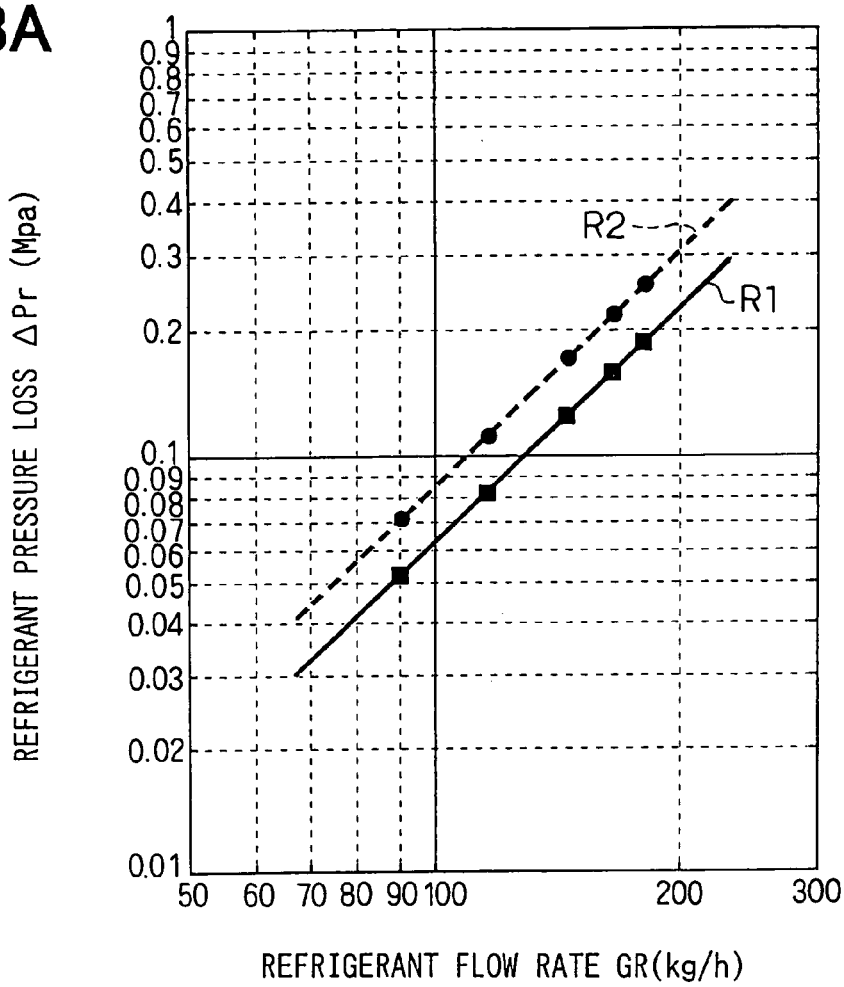
FIG. 8A is a graph showing the relationship between a flow rate and pressure loss of the refrigerant in the refrigerant evaporator of the sixth embodiment.
FIG. 8B is a table showing the relationship between an air volume and temperature difference in the refrigerant evaporator of the sixth embodiment and that of a comparison evaporator.

Under the above conditions, air is applied to the core by two blowers with different volumes. The voltages to the two blowers are independently controlled. The temperature of air passing through the core-during the right and left independent control is measured by a thermo-viewer (infrared-thermometer). The core is divided into four measuring areas in the core width direction D1 and two measuring areas in the up and down direction. The average of measured temperatures is compared to the respective areas, and the temperature difference between a highest temperature area and a lowest temperature area is detected. The result of the temperature difference test is shown in a table of FIG. 8B. In the table, "L" and "R" represent the left blower and the right blower. As shown in FIG. 8B, in the evaporator of the embodiment shown in FIG. 7A, the temperature difference increases with the difference of the air volumes.

In the above first to sixth embodiments, the number of refrigerant inlet is not limited. Multiple refrigerant inlets can be provided as in a seventh embodiment shown in FIG. 9.

Figure 9:
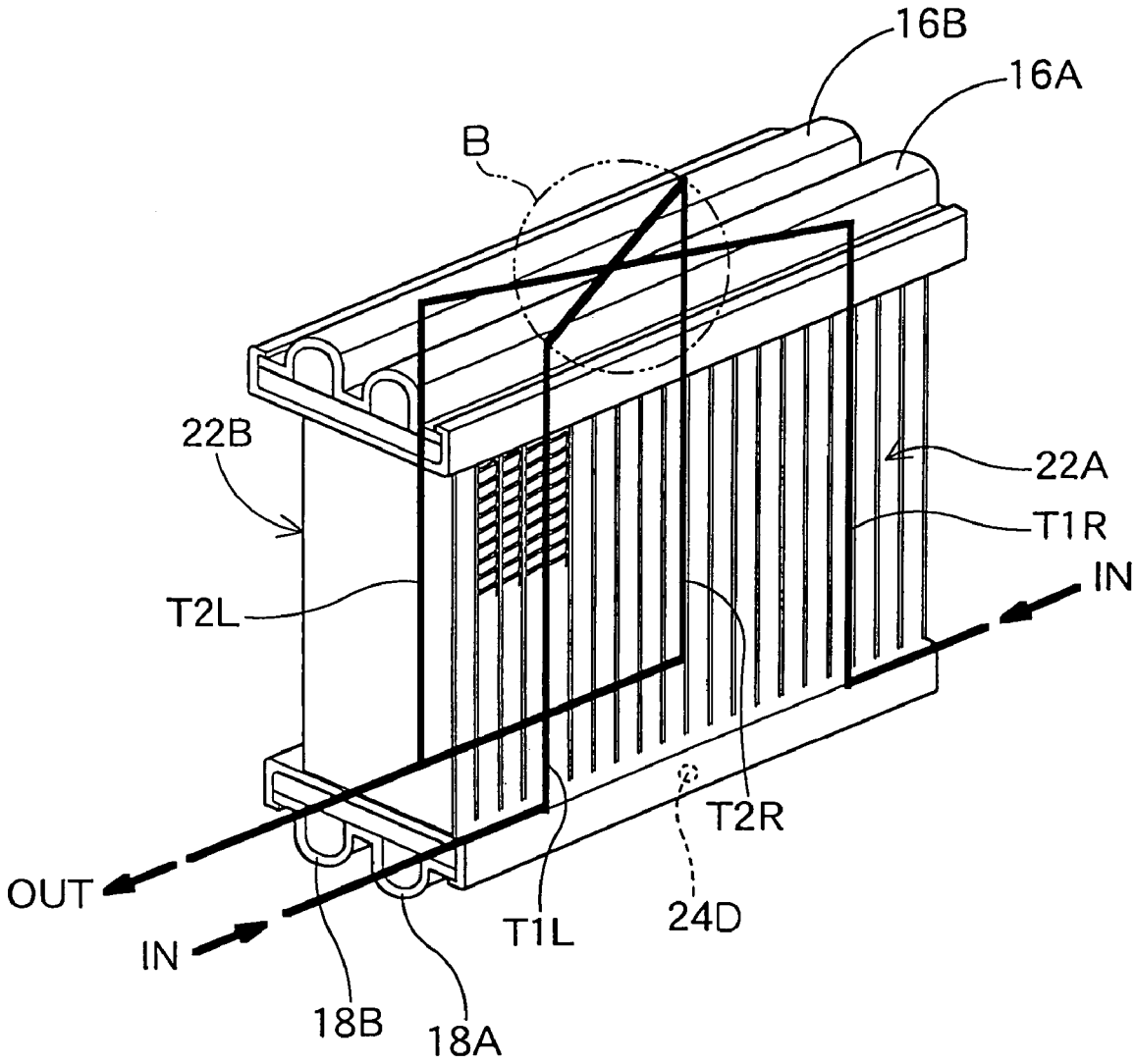
FIG. 9 is a perspective view of the refrigerant evaporator according to a seventh embodiment of the present invention.

In the evaporator of FIG. 9, two refrigerant inlets are exemplary formed on the lower front tank portion 18A. A separator 24D is provided in the front lower tank portion 18A. This type is effective for the evaporator with a large core width. The refrigerant intersectional portion is provided in the upper tank portions 16A, 16B, in a manner similar to the above embodiments.

In the above first to seventh embodiments, the front tubes 20A and the rear tubes 20B are separately provided. The coreportions 22A, 22B are provided by separate rows of tubes 22A, 22B. Alternatively, the core of the evaporator can be formed of flat tubes defining passages therein, as in a following eighth embodiment. That is, the core can be formed with a single row of tubes.

Figure 10A:
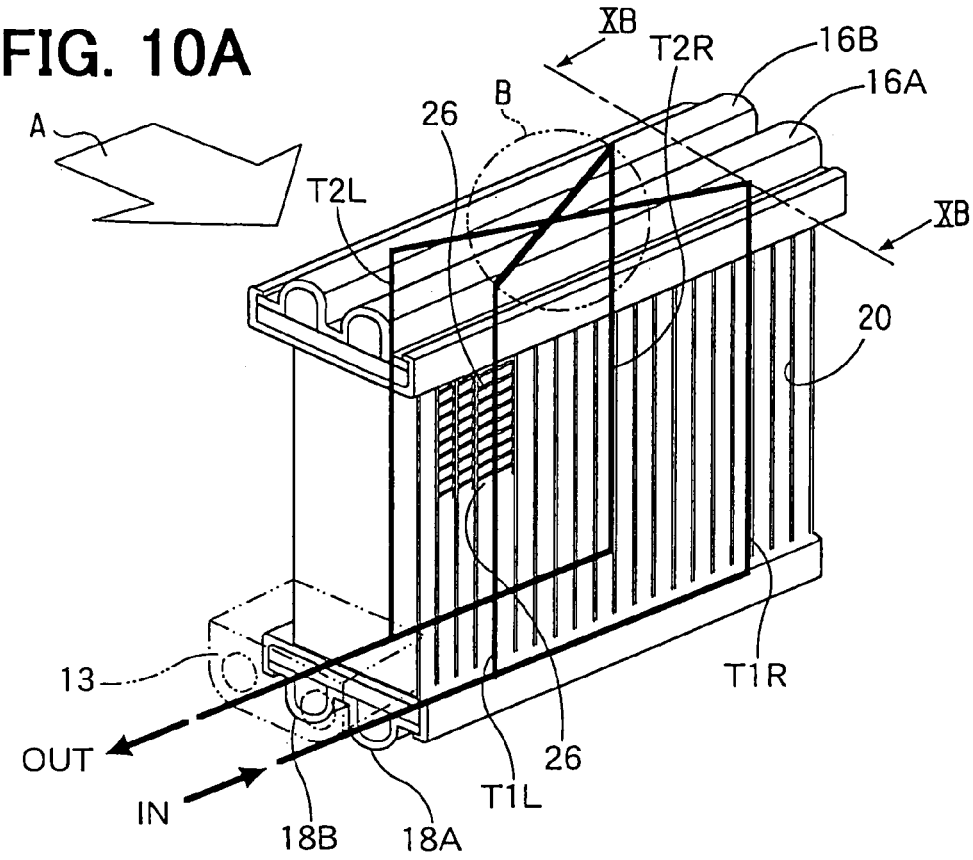
FIG. 10A is a perspective view of the refrigerant evaporator according to an eighth embodiment of the present invention.

In the eighth embodiment shown in FIG. 10A, the tubes 20 are arranged in a single row in the core width direction D1 between the upper front and rear tank portions 16A, 16B and the lower front and rear tank portions 18A, 18B. Each of the tubes 20 has a flat tube cross-section and defines multiple refrigerant passage holes 20*a* therein, as shown in FIG. 10C. The tube 20 is for example formed by extrusion.

Notches 20*b* are formed at a top end and a bottom end of the tube 20 at a middle portion with respect to a tube width direction, as shown in FIG. 10C. An upper tank plate 15A and a lower tank plate 15B, and an upper communication plate 40A and a lower communication plate 40B are provided. In each of the communication plates 40A, 40B, communication holes 40*c* are formed in two rows in a longitudinal direction of the communication plate 40A, 40B. In each of the tank plates 15A, 15B, two grooves extending in the longitudinal direction of the tank plate 15A, 15B are formed. The two grooves of the upper tank plate 15A define the upper front tank portion 16A and the upper rear tank portion 16B. The two grooves of the lower tank plate 15B define the lower front tank portion 18A and the lower rear tank portion 18B.

Figure 10B:
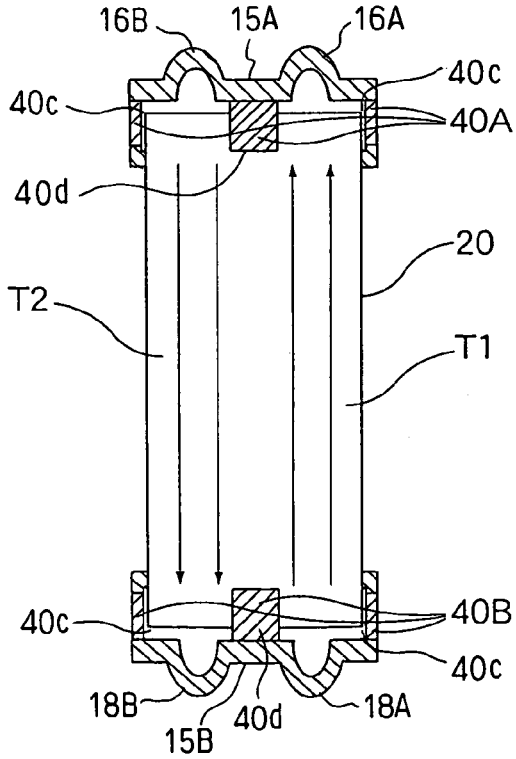
FIG. 10B is a schematic cross-sectional view of there frigerant evaporator shown in FIG. 10A taken along a line XB-XB.
Figure 10C:
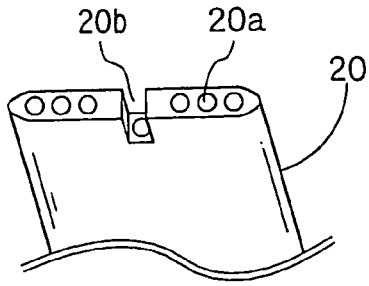
FIG. 10C is a partly enlarged perspective view of a tube of the refrigerant evaporator shown in FIG. 10A.

The communication plates 40A, 40B are connected to the tubes 20 such that the ends of the tubes 20 fits in the communication holes 40*c*, as shown in FIG. 10B. At this time, the notches 20*b* of the tubes 20 fits with separation walls 40*d* formed between the communication holes 40*c* of the communication plates 40A, 40B. Further, the tank plates 15A, 15B are connected to the communication plates 40A, 40B. In this way, the space in the upper tank is divided into the upper front tank space 16A and the upper rear tank space 16B. The space in the lower tank is divided into the lower front tank space 18A and the lower rear tank space 18B.

In this evaporator, the first refrigerant passes T1 are made in the passage holes 20*a* on the front side of the tubes 20 and the second refrigerant passes T2 are made in the passage holes 20*a* on the rear side of the tubes 20, as shown in FIG. 10B. Accordingly, advantages similar to the above embodiments are provided.

In the above first to eighth embodiments, the first pass T1 and the second pass T2 are formed on the front side and the rear side of the core with respect to the air flow direction A. That is, the refrigerant makes turn in the tank portions 16A, 16B from the front side to the rear side of the core. Alternatively, the evaporator can be constructed such that the refrigerant makes turn in the core width direction D1 as follows.

In a ninth embodiment shown in FIGS. 11 to 14E, the tubes 20 are arranged such that the refrigerant makes the first pass T1 and the second pass T2 alternately in a row in the core width direction D1.

Specifically, the core portion 22 including the tubes 20 is arranged between the upper front and rear tank portions 16A, 16B and the lower front and rear tank portions 18A, 18B. The tubes 20 have flat tube cross-sections. In the core portion 22, the tubes 20 are arranged in a single row in the core width direction D1.

Figure 13:
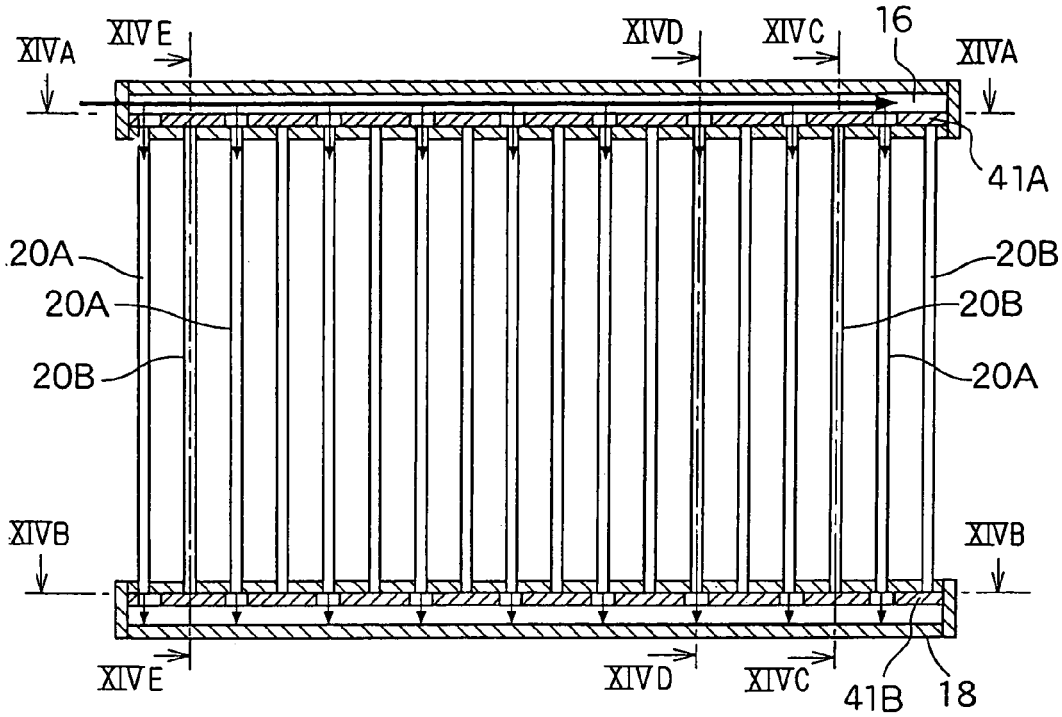
FIG. 13 is a schematic cross-sectional view of the refrigerant evaporator according to the ninth embodiment of the present invention.

The refrigerant flows from the refrigerant inlet of the connector 13 to the upper front tank portion 16A. After passing through the core 22, the refrigerant discharges from the refrigerant outlet of the connector 13 through the upper rear tank portion 16B. As shown in FIG. 13, in the group of tubes 20, the first tube 20A in which the first refrigerant pass T1 is made and the second refrigerant tube 20B in which the second refrigerant pass T2 is made are alternately arranged.

Figure 14A:
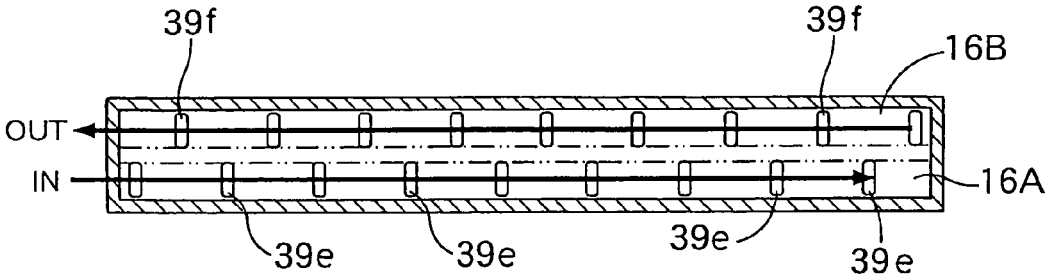
FIG. 14A is a cross-sectional view of the refrigerant evaporator shown in FIG. 13 taken along a line XIVA-XIVA.

As shown in FIGS. 14A to 14E, an upper communication plate 41A is connected to the upper tank plate 15A so that the upper front tank space 16A is separate from the upper rear tank space 16B. As shown in FIG. 14A, first and second communication holes 39*e*, 39*f* are formed on the upper communication plate 41A in rows in the core width direction D1, at positions corresponding to the open ends of the first and second tubes 20A, 20B, respectively. The first tubes 20A communicate with the upper front tank portion 16A through the first communication holes 39*e*, and the second tubes 20B communicate with the upper rear tank portion 16B through the second communication holes 39*f*.

Figure 14B:
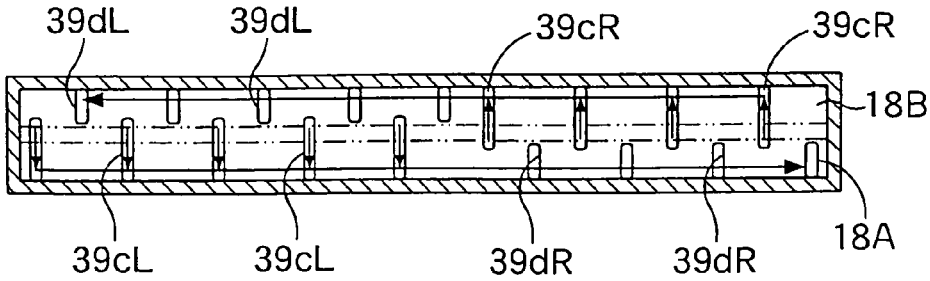
FIG. 14B is a cross-sectional view of the refrigerant evaporator shown in FIG. 13 taken along a line XIVB-XIVB.
Figure 14C:
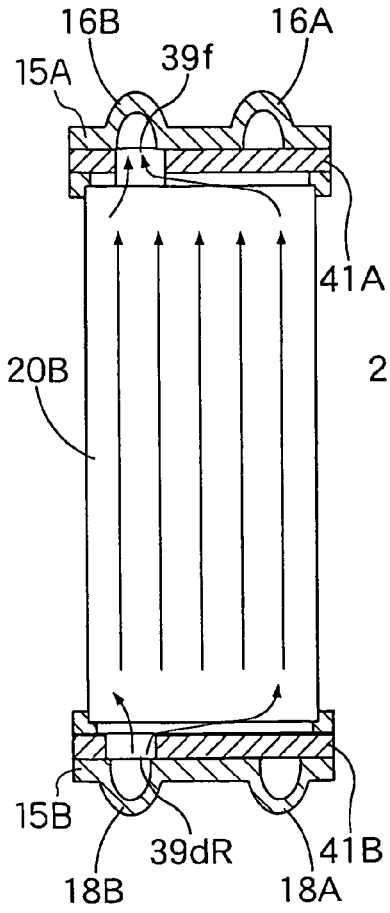
FIG. 14C is a cross-sectional view of the refrigerant evaporator shown in FIG. 13 taken along a line XIVC-XIVC.
Figure 14D:
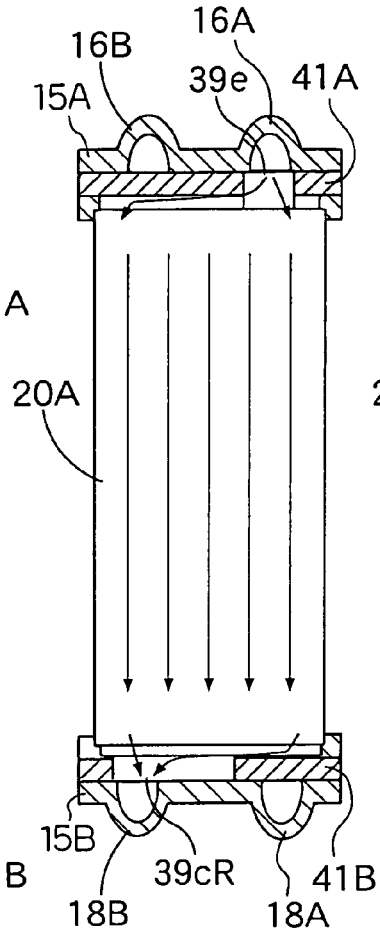
FIG. 14D is a cross-sectional view of the refrigerant evaporator shown in FIG. 13 taken along a line XIVD-XIVD.
Figure 14E:
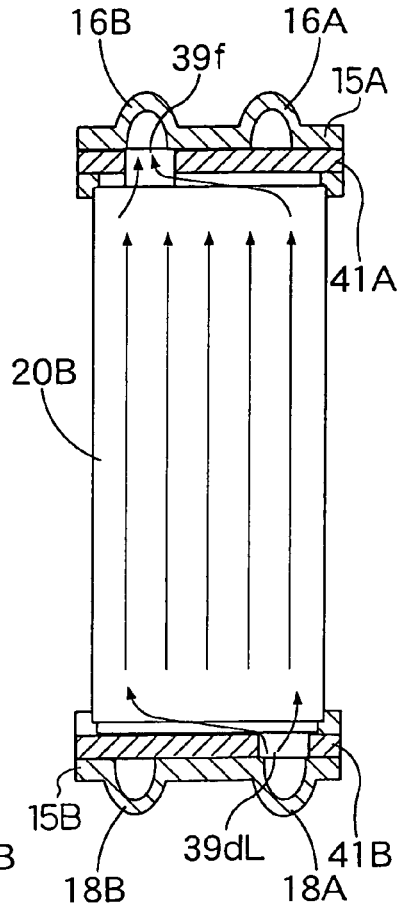
FIG. 14E is a cross-sectional view of the refrigerant evaporator shown in FIG. 13 taken along a line XIVE-XIVE.

Further, a lower communication plate 41B is connected to the lower tank plate 15B. As shown in FIG. 14B, the second communication plate 41B is formed with communication holes 39*c*R, 39*c*L at positions corresponding to the lower open ends of the first tubes 20A and communication holes 39*d*R, 39*d*L at positions corresponding to the lower open ends of the second tubes 20B. The communication holes 39*c*R, 39*c*L, 39*d*R, 39*d*L are arranged in rows in the core width direction. The communication holes 39*d*R are located in the front right section of the lower communication plate 41B to correspond to the front portions of the first tubes 20A in the right section of the core portion 22. The communication holes 39*c*L are located in the front left section of the lower communication plate 41B to correspond to the front portions of the first tubes 20A in the left section of the core portion 22. The communication holes 39*c*R are located in the rear right section of the lower communication plate 41B to correspond to the rear portions of the second tubes 20B in the right section of the core portion 22. The communication holes 39*c*L are located in the rear left section of the lower communication plate 41B to correspond to the rear portions of the second tubes 20B in the left section of the core portion 22.

In the above configuration, the refrigerant flows as shown by arrows in FIGS. 12 to 14E. Specifically, the refrigerant flows from the upper front tank portion 16A to the first tubes 20A through the communication holes 39*e* and makes the first passes T1 in the first tubes 20A. Then, the refrigerant flowing in the first tubes 20A in the left section of the core portion 22 flows in the lower front tank portion 18A through the communication holes 39*c*L and makes turn in the lower front tank portion 18A. Then, the refrigerant flows in the second tubes 20B in the right section of the core portion 22 through the communication holes 39*d*R and makes the second passes T2 in the right second tubes 20B. On the other hand, the refrigerant flowing in the first tubes 20A in the right section of the core portion 22 flows in the lower rear tank portion 18B through the communication holes 39*c*R and makes turn in the lower rear tank portion 18B. Then, the refrigerant flows in the second tubes 20B in the left section of the core portion 22 through the communication holes 39*d*L and makes the second passes T2 in the left second tubes 20B. The refrigerant passed through the second passes T2 collects in the upper rear tank portion 16B through the communication holes 39*f* and discharges from the refrigerant outlet of the connector 13.

In this embodiment, the flow direction of the refrigerant are changed with respect to the core width direction D1, that is, the right and left direction of the core portion 22. Similar to the embodiments in which the front core portion 22A and the rear core portion 22B are arranged with respect to the air flow direction A, the amount of refrigerant evaporation is uniform in the core portion 22. Accordingly, the temperature of air passing through the core portion 22 is uniform with respect to the core width direction D1. Because the number of turns of the refrigerant is small, the pressure loss of the refrigerant is reduced. Even if dry-out area and super heated area are created in the second tubes 20B in which the refrigerant makes second passes T2, heat exchange is performed through the fins 26 and the first tubes 20A in which the refrigerant makes the first passes T1. Accordingly, the amount of heat is uniform with respect to the core width direction D1 and the temperature distribution is improved.

In the general evaporator, the air having the air distribution generated in the super heated area is heat exchanged at the air-downstream side (refrigerant-upstream side) of the core and is cooled. That is, the air distribution is reduced by setting the flow direction of the refrigerant perpendicular to the air flow direction. On the other hand, in the embodiment, the tubes 20A, 20B are arranged in the single row in the core portion 22. The second tubes 20B in which the super-heated areas are created can be placed between the first tubes 20A in which the super-heated areas are not created. Therefore, the temperature distribution is improved in the core portion having a single row of tube arrangement.

In a cycle in which the evaporator is used such that the flow direction of the refrigerant is reversed, the temperature distribution is improved as follows.

Figure 20A:
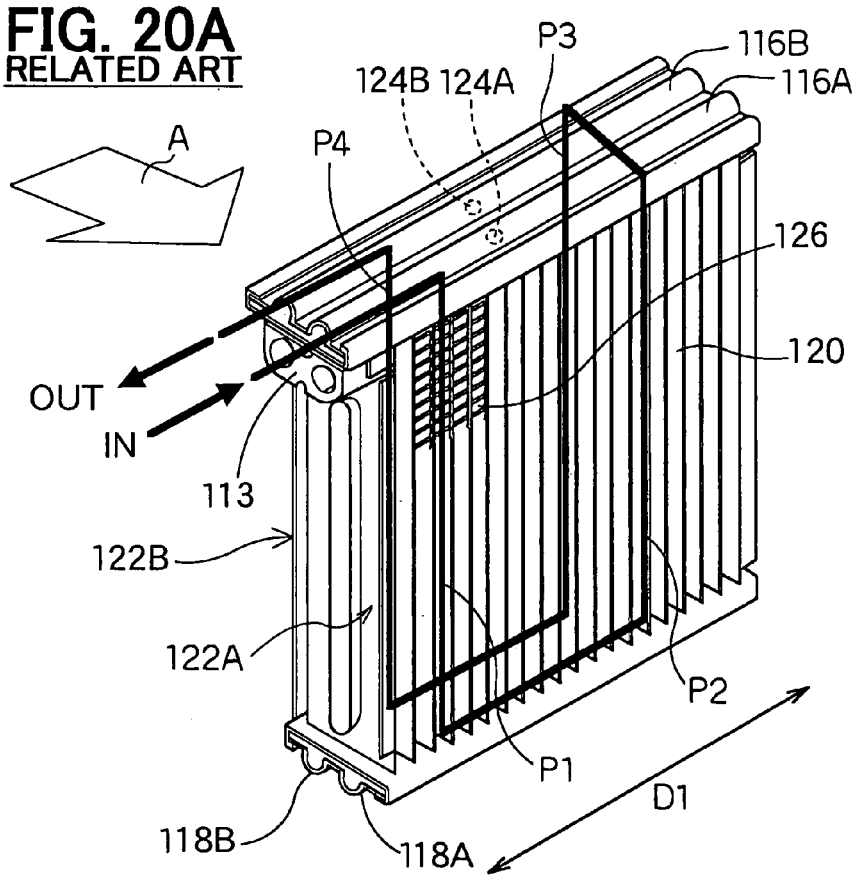
FIG. 20A RELATED ART
FIG. 20A is a perspective view of 2-2 pass-type refrigerant evaporator of a related art.
Figure 20B:
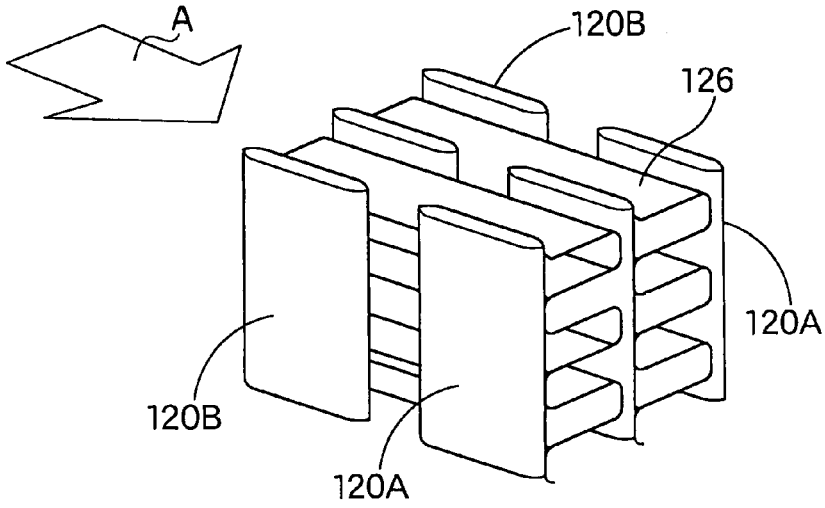
FIG. 20B RELATED ART
FIG. 20B is a perspective view of a part of the refrigerant evaporator shown in FIG. 20A for showing tube and fin arrangement.
Figure 21:
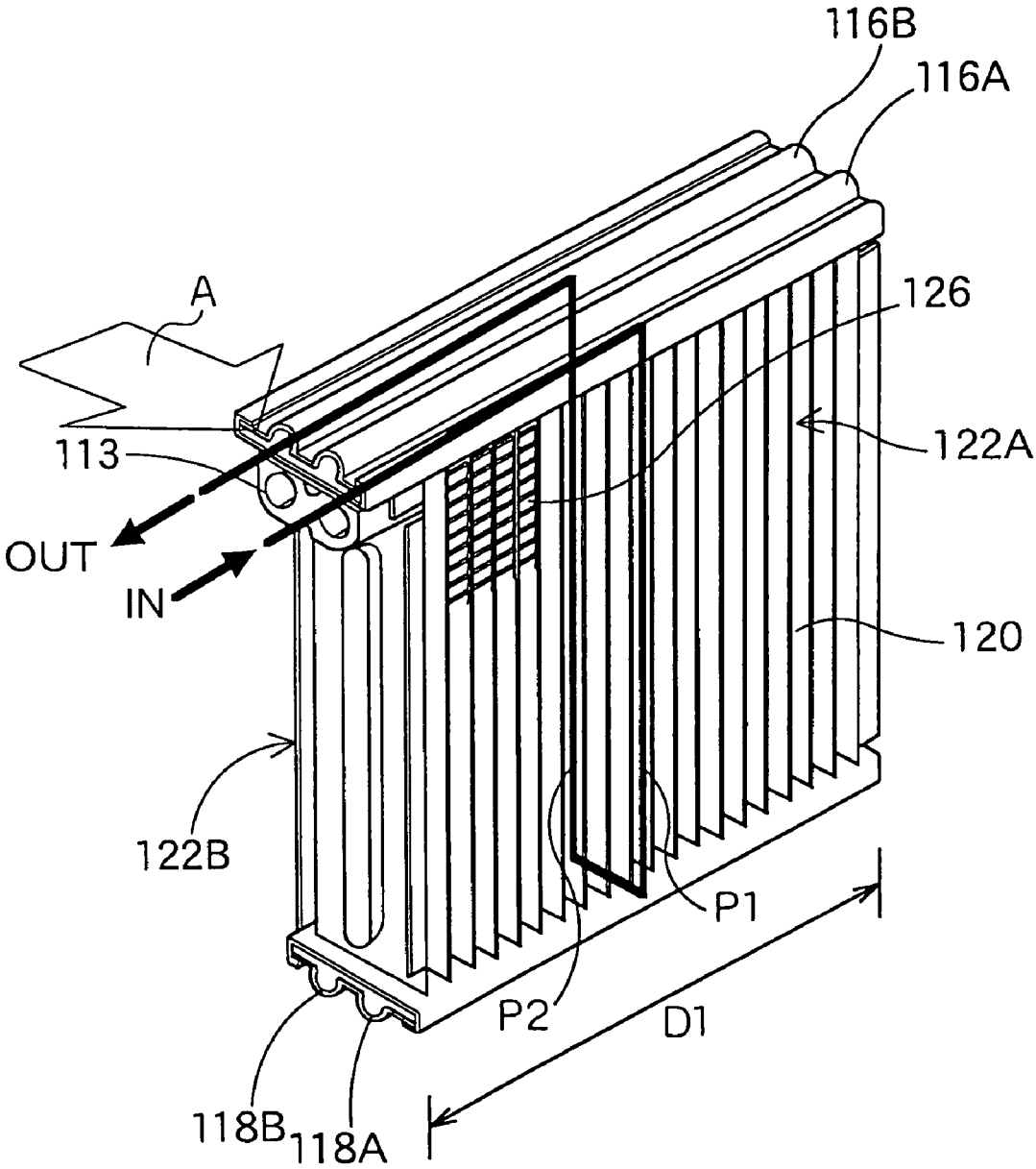
FIG. 21 RELATED ART
FIG. 21 is a perspective view of a front and rear U-turn-type refrigerant evaporator of a related art.

In the evaporator shown in FIGS. 20A, 20B, 21, for example, the refrigerant flows such that the heat exchange is performed in the rear core portion 22B on the air-upstream side after in the front core portion 22A on the air-downstream side. Thus, the refrigerant turns from the air-downstream side to the air-upstream side. That is, the flow of the refrigerant in a broad view is opposite to the flow of the air in a broad view. In this evaporator, when the flow of the refrigerant is reversed by replacing the refrigerant inlet with the refrigerant outlet, the flow direction of the refrigerant is the same as the flow direction of the air in the broad view. In this case, the super-heated area and the like created around the refrigerant outlet appears as the air-blowing temperature distribution area. On the other hand, in the embodiment in which the core is arranged in the single row, even if the flow direction of the refrigerant is reversed, the refrigerant flow direction is not parallel to the air flow direction A, but perpendicular to the air flow direction A. That is, the flow of the refrigerant is made symmetric with respect to the core width direction D1. Accordingly, the temperature distribution is improved. Further, this single row core arrangement can be employed to a radiator. In the radiator, the air distribution is improved.

If the refrigerant is carbon dioxide, the refrigerant flows in the heat exchanger in a super critical state. However, the refrigerant does not isothermally change. Especially, after the refrigerant flows in the heat exchanger, the temperature of the refrigerant is immediately decreased. In the core portion with a single row tube arrangement, the temperature change of the refrigerant directly appears as the blowing air temperature distribution. However, in the ninth embodiment shown in FIGS. 11 to 14E, the first tube 20A in which the refrigerant with high temperature right after flowed in the heat exchanger flows and the tube 20B in which the refrigerant with low temperature before discharging are alternately arranged. Therefore, the improved air distribution is provided.

In the ninth embodiment, the first tube 20A through which the refrigerant flows in a downward direction to make the first pass T1 and the tube 20B through which the refrigerant flows in an upward direction to make the second pass T2 are alternately arranged. However, the core portion 22 can be formed by alternately arranging a set of first tubes 20A and a set of second tubes 20B. For example, two or three first tubes 20A and two or three second tubes 20B are alternately arranged. In this case, similar effect can be provided.

Accordingly, the core with the single row tube arrangement can improve air distribution as the evaporator and the radiator. Thus, this core arrangement can be employed to both the evaporator and the radiator. Here, the evaporator means the heat exchanger in which the refrigerant absorbs heat and evaporates while performing heat exchange between the refrigerant and the external fluid to be cooled (for example, air). The radiator means the heat exchanger in which the refrigerant radiates heat to cool itself.

Figure 15:
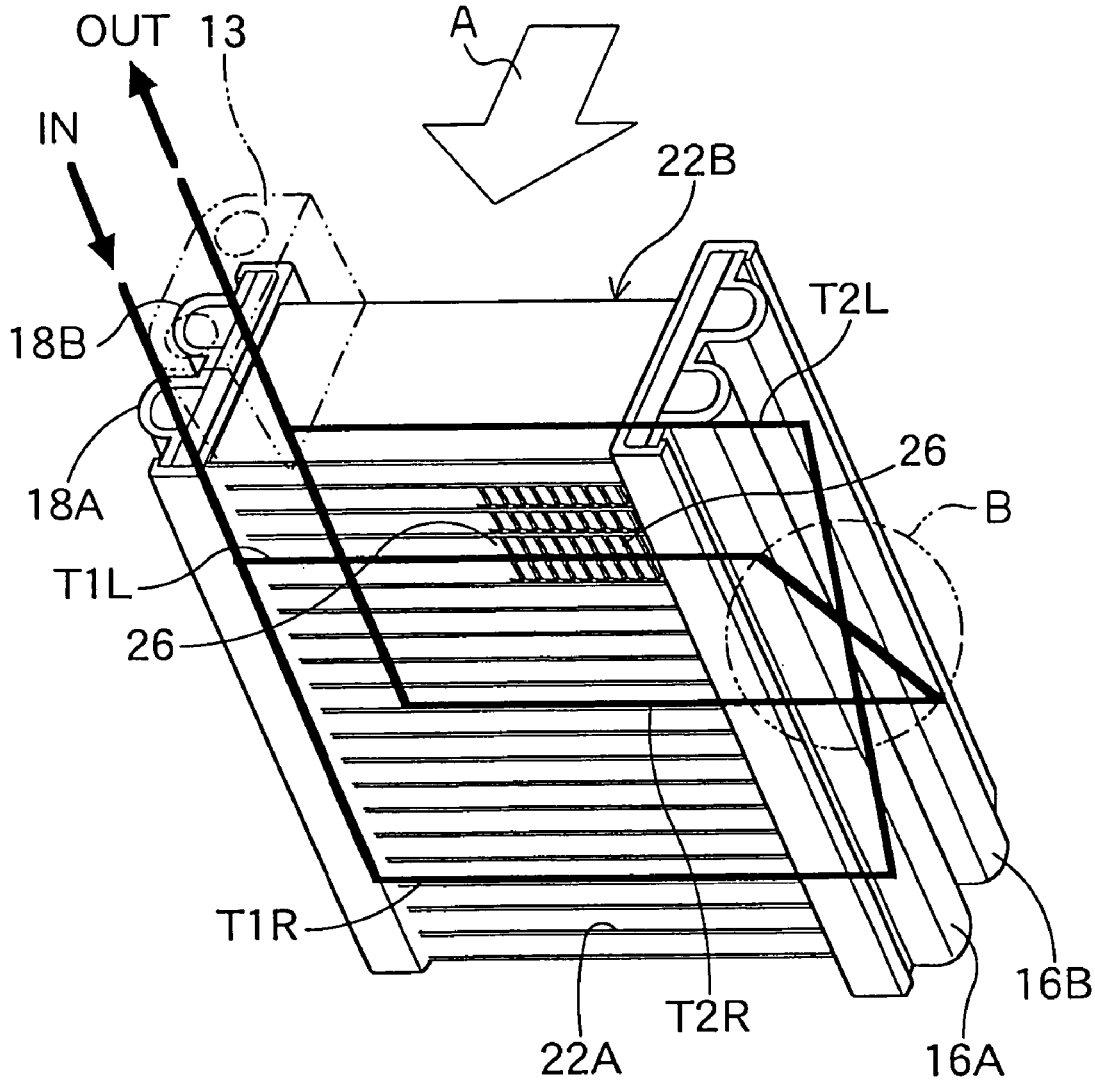
FIG. 15 is a perspective view of the refrigerant evaporator according to a tenth embodiment of the present invention.

In the above first to ninth embodiments, the tubes 20, 20A, 20B are arranged vertically and the tanks 16A, 16B, 18A, 18B are connected to the top and bottom ends of the tubes 20, 20A, 20B. The mounting position of the heat exchanger is not limited to the above when in use. For example, the tanks 16A, 16B, 18A, 18B are arranged vertically and the cores 22A, 22B are arranged horizontally between the tanks 16A, 16B, 18A, 18B. That is, the tubes 20, 20A, 20B are arranged horizontally and layered in the vertical direction, as shown in FIG. 15 of a tenth embodiment. In this configuration, the similar advantages can be provided. In addition, the unevenness of the temperature in the vertical direction can be reduced. The refrigerant evaporator shown in FIG. 15 is provided by turning the refrigerant evaporator shown in FIG. 1A at 90 degrees.

Figure 11:
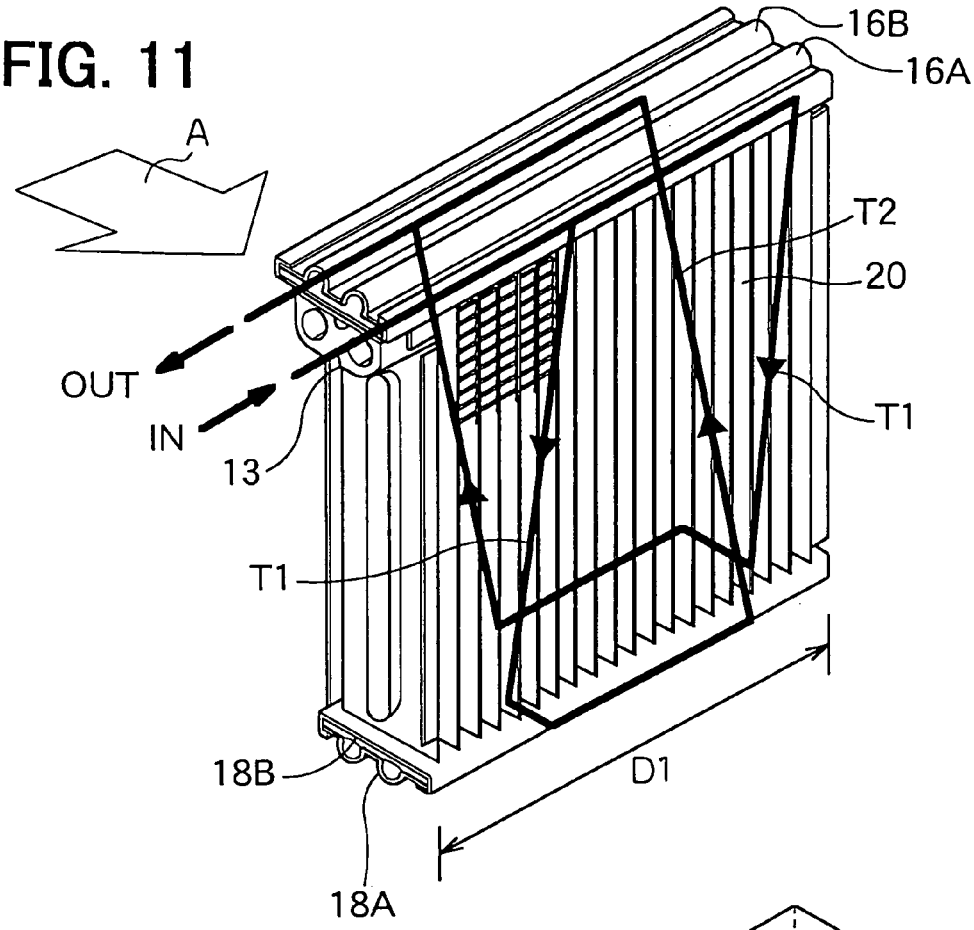
FIG. 11 is a perspective view of the refrigerant evaporator according to a ninth embodiment of the present invention.
Figure 12:
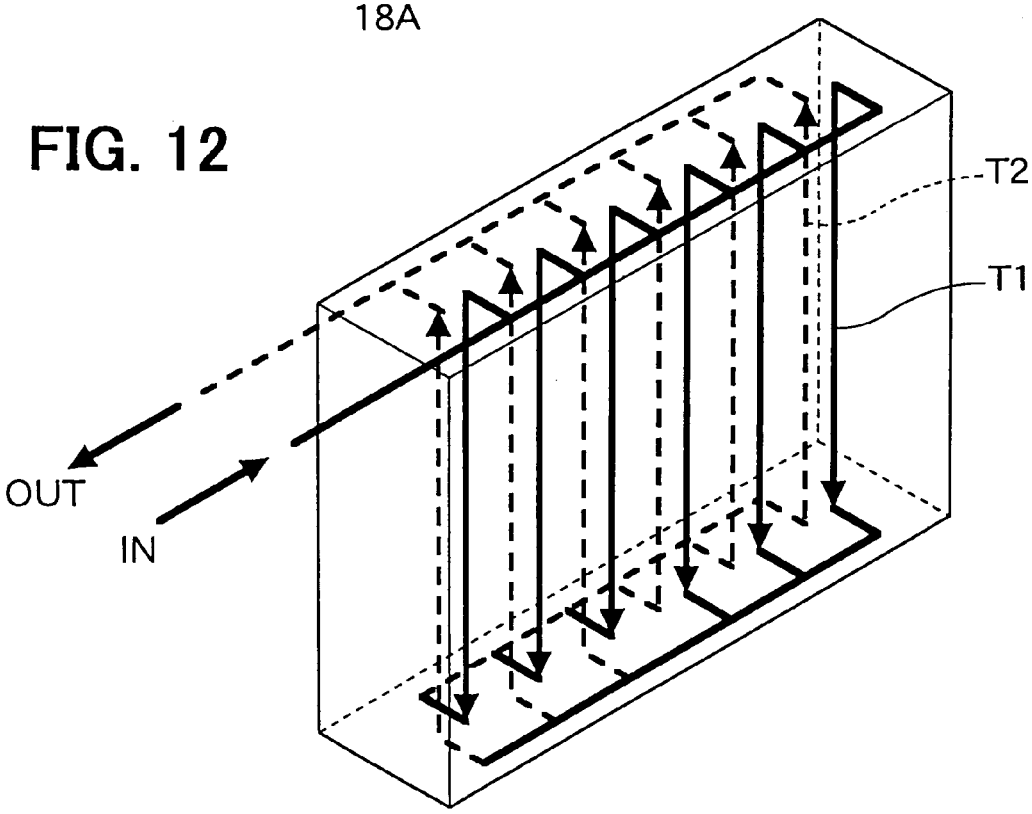
FIG. 12 is an explanatory view for explaining a flow of the refrigerant in the refrigerant evaporator' shown in FIG. 11.
Figure 16A:
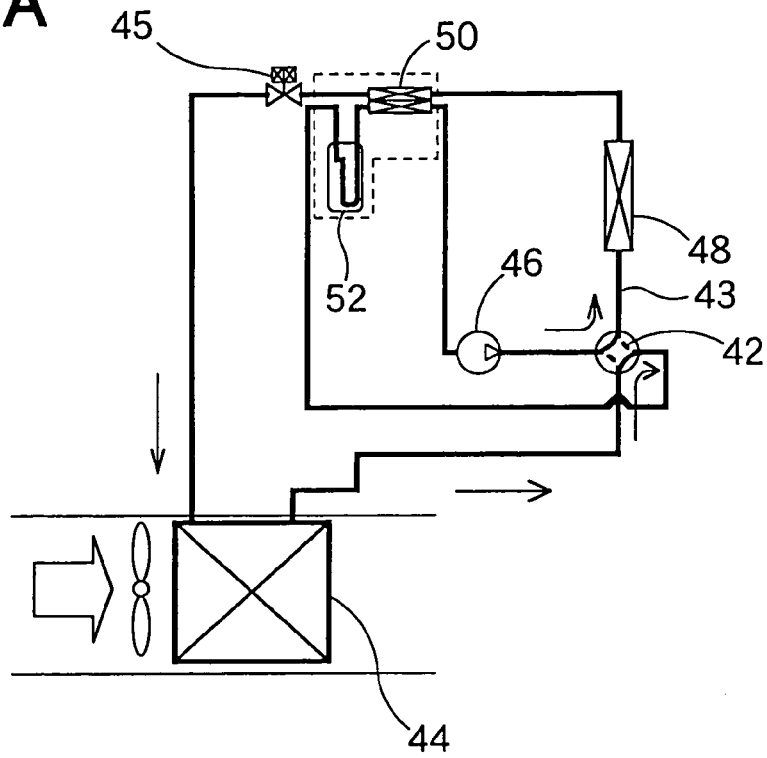
FIG. 16A is a schematic diagram of a refrigerant circuit having the refrigerant evaporator with a single row tube arrangement in a cooling mode.
Figure 16B:
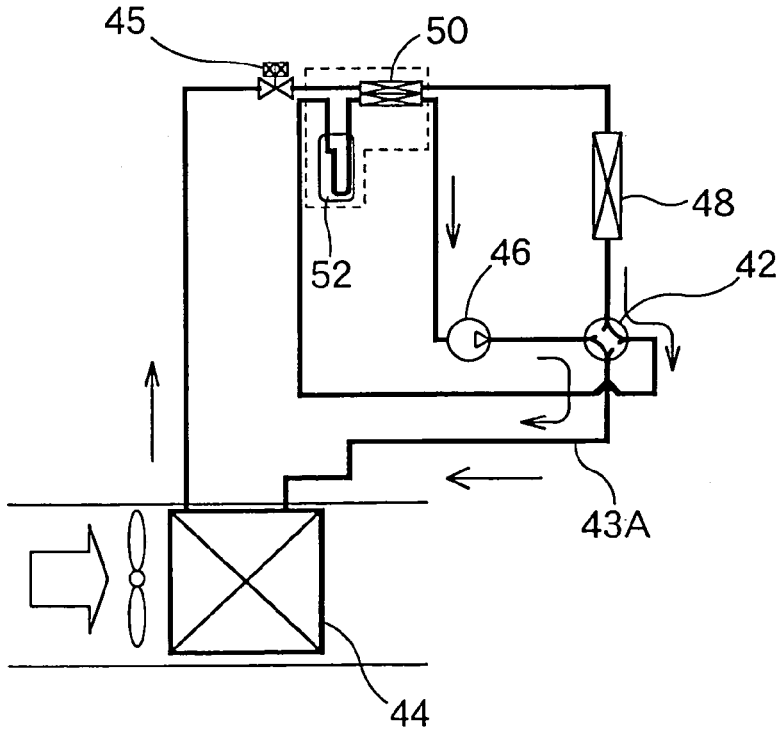
FIG. 16B is a schematic diagram of the refrigerant circuit having the refrigerant evaporator with the single row tube arrangement in a heating mode.

The heat exchanger described in the above embodiments can be employed to a refrigerant circuit having an internal heat exchanger, as shown in FIGS. 16A and 16B. For example, the heat exchanger shown in FIG. 11 is used as an inside heat exchanger 44. In the refrigerant circuit, switching valve (four-way valve) 42 is provided. In this circuit, the operation mode is switched between the cooling mode (FIG. 16A) and the heating mode (FIG. 16B) by the switching valve 42. Hereafter, the structure of the refrigerant circuit in which carbon dioxide is used in the super critical state as the refrigerant will be exemplary explained.

In the cooling mode shown in FIG. 16A, the refrigerant, which has been compressed in a compressor 46, is introduced to an outside heat exchanger (radiator) 48 through a pipe 43 by switching operation of the switching valve 42. In the outside heat exchanger 48, heat exchange is performed between the high pressure refrigerant and high temperature air. Therefore, high pressure, high temperature refrigerant is discharged from the outside heat exchanger 48. Then, the refrigerant is changed into low pressure, low temperature refrigerant through an internal heat exchanger (IHX) 50, in which heat exchange is performed between the refrigerants, and an expansion valve (pressure-reducing device) 45 and flows into the inside heat exchanger (evaporator) 44. In the inside heat exchanger 44, the refrigerant absorbs heat from the air to be blown into a compartment, thereby to cool the air. Then, the refrigerant is introduced into a receiver 52. In the receiver 52, the refrigerant is separated into gas refrigerant and liquid refrigerant. Then, the refrigerant returns to the compressor 46 and thereafter changed into the high pressure, high temperature refrigerant. In FIGS. 16A, 16B, arrows denote the flow direction of the refrigerant.

In the heating mode shown in FIG. 16B, the refrigerant compressed in the compressor 46 is introduced to the inside heat exchanger (radiator) 44 through a pipe 43A by the switching valve 42. In the inside heat exchanger 44, the refrigerant radiates heat to low temperature air, thereby to heat the air. Thus, the high pressure, low temperature refrigerant is discharged from the inside heat exchanger 44. Then, the refrigerant is changed into low pressure, low temperature refrigerant through the expansion valve 45. Then, the low pressure, low temperature refrigerant flows in the outside heat exchanger (evaporator) 48. In the outside heat exchanger 48, the refrigerant absorbs heat. Then, the refrigerant is introduced to the internal heat exchanger (IHX) 50 through the switching valve 42. Further, the refrigerant returns to the compressor 46 and thereafter changes into the high pressure, high temperature refrigerant.

In the heat exchanger 44 having the single row of tube arrangement, the refrigerant inlet can be provided at the lower side. Alternatively, the refrigerant inlet and the refrigerant outlet can be provided on the right side and the left side thereof. Further, two refrigerant inlets can be provided. Also, it is not always necessary that the tube 20A through which the refrigerant makes the first pass T1 and the tube 20B through which the refrigerant makes the second pass T2 are arranged alternately. Alternatively, a set of the tubes 20A and a set of the tubes 20B, each of the set including a predetermined number of tubes, are alternately arranged.

By using the heat exchanger of the embodiments in combination with the internal heat exchanger, since the dryness of the refrigerant at the refrigerant inlet side of the heat exchanger is reduced, the temperature distribution is further improved. Also, the difference of enthalpy at the refrigerant outlet side is increased. Accordingly, the performance is improved.

In the above embodiments, the flows of the refrigerant having passed through the first pass T1 are crossed in the horizontal direction in the intersectional portion before flowing in the second pass T2. Alternatively, the flows of refrigerant can be crossed after a plurality of first passes T1 had been made. Also, the number of the intersectional portion is not limited. The intersectional portion can be provided at the plural positions.

The structure of the present invention can be employed to the serpentine type heat exchanger in which the flow of the refrigerant is formed in serpentine shape through the plural tubes in the front and rear core portions and plural refrigerant passes are formed.

Figure 17:
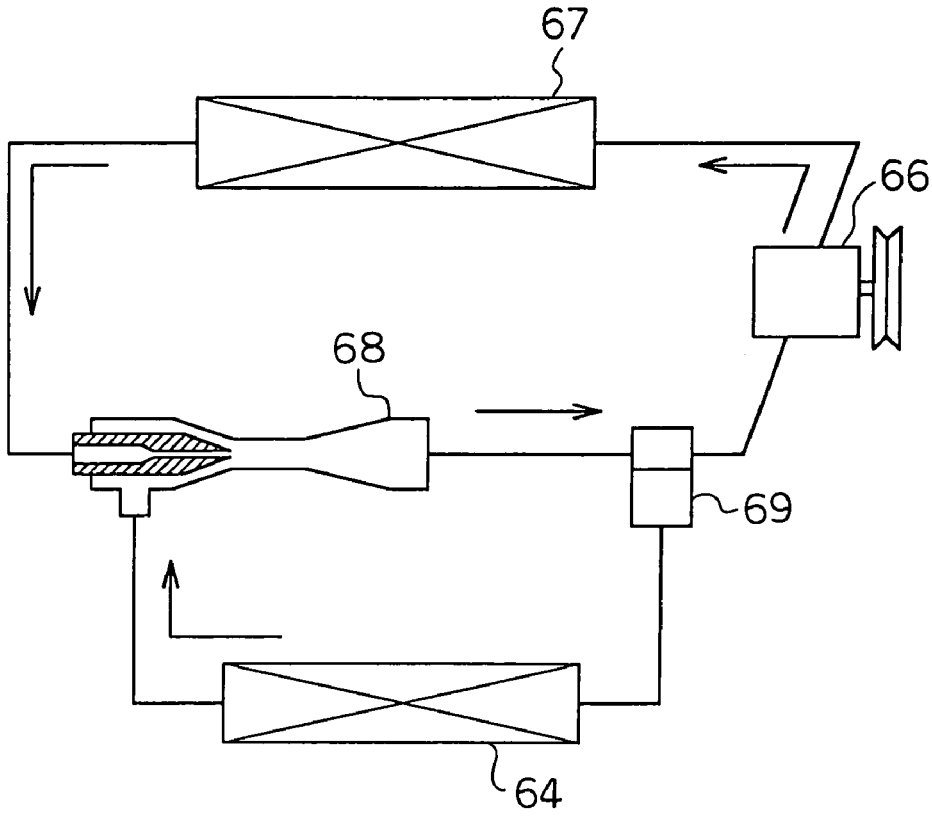
FIG. 17 is a schematic diagram of a refrigerating cycle having the refrigerant evaporator of the embodiments and an ejector.
Figure 18:
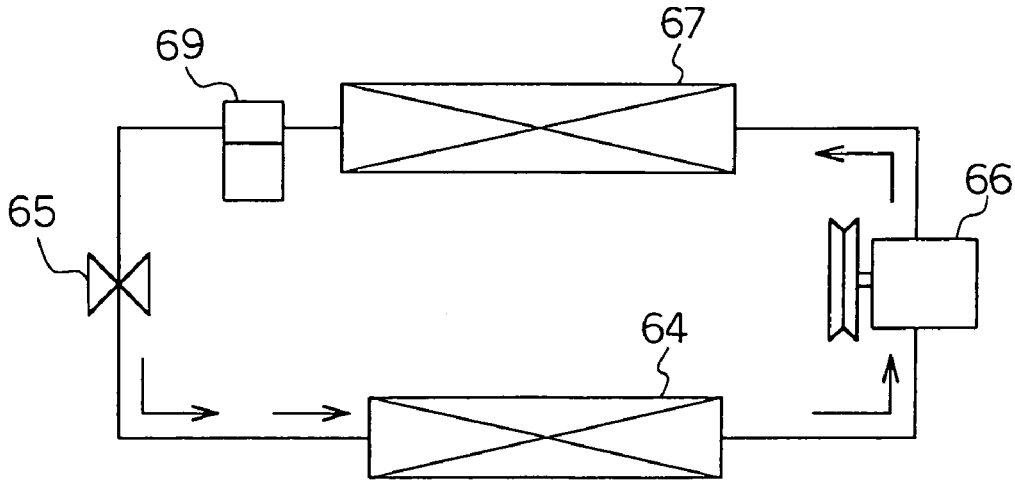
FIG. 18 is a schematic diagram of a refrigerating cycle having the refrigerant evaporator of the embodiments and a pressure-reducing device.
Figure 19:
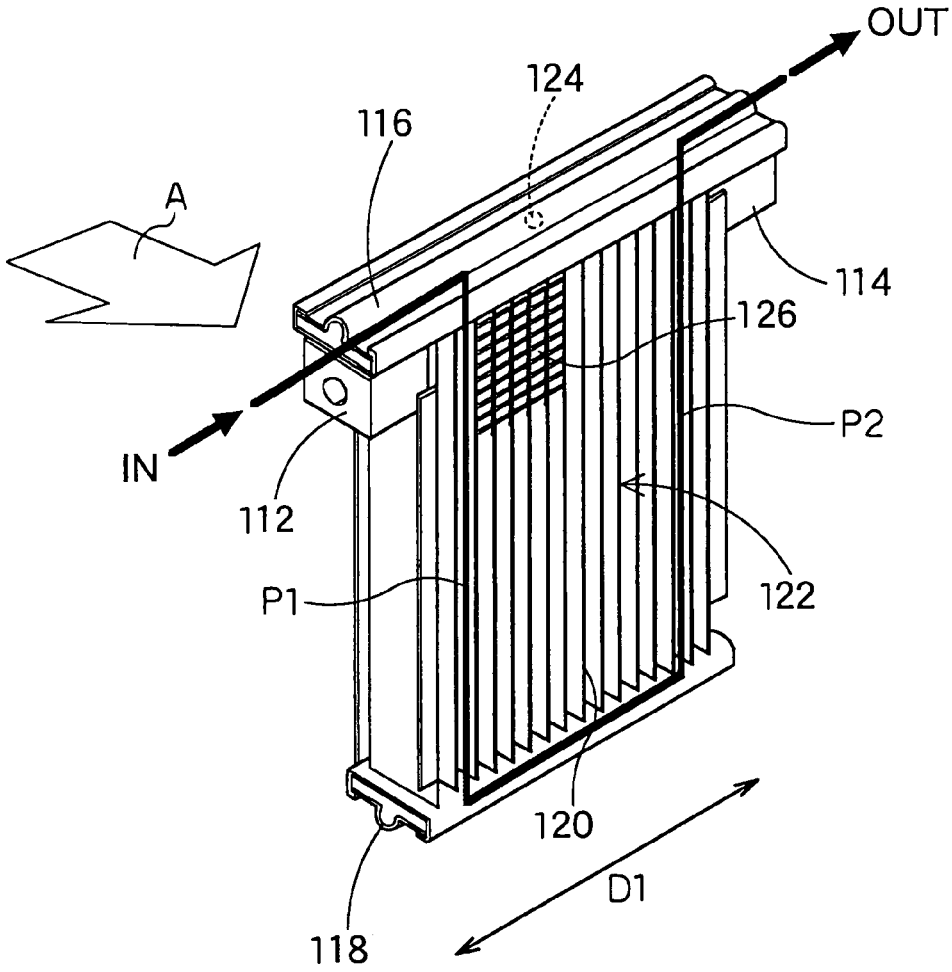
FIG. 19 RELATED ART
FIG. 19 is a perspective view of a multi-flow-type refrigerant evaporator of a related art.

Further, the above-described refrigerant evaporator can be employed in a refrigerating cycle including an ejector and an internal heat exchanger, as shown in FIGS. 17 and 18. The refrigerating cycle of FIG. 17 has a compressor 66, a radiator 67, an ejector 68, a gas-liquid separator 69 and an evaporator 64. The refrigerating cycle shown in FIG. 18 has a pressure reducing device (expansion valve) 65 in place of the ejector 68 of FIG. 17.

Preferably, in the refrigerant cycle shown in FIG. 17, a gas-liquid separator 69 is arranged upstream of the evaporator 64. In the refrigerant cycle shown in FIG. 18, the gas-liquid separator 69 is preferably arranged upstream of the pressure-reducing device 65. Because the dryness of the refrigerant is reduced at the refrigerant inlet side of the evaporator 64, this arrangement is preferable in view of improvement of the temperature distribution in the core width direction D1 and the cooling performance.

The evaporator of the embodiments is used in combination with the ejector. In the ejector cycle, the less the pressure loss of the refrigerant at the low pressure side (for example, in the evaporator, and gas-liquid separator) is, the more the refrigerant flow rate to the low pressure side is increased. Accordingly, the performance is further improved.

The present invention should not be limited to the disclosed embodiment, but may be implemented in other ways without departing from the spirit of the invention.

In the above description, the present invention is applied to the refrigerant evaporator in which the external fluid (first fluid) is air and the internal fluid (second fluid) is the refrigerant. Alternatively, the present invention can be employed to the heat exchanger that performs heat exchange between the first fluid and the second fluid other than the refrigerant. The heat exchanger can be used to heat the first fluid.

What is claimed is:

1. A heat exchanger for performing heat exchange between an external fluid flowing outside thereof and an internal fluid flowing therein, comprising:

a core portion having a first core section and a second core section, the first core section and the second core section being disposed in a core width direction that is substantially perpendicular to a flow direction of the external fluid, the core portion including a plurality of tubes arranged in at least one row in the core width direction, the tubes defining first passages in the first and second core sections and second passages in the first and second core sections, one of the first passages and the second passages being disposed upstream of the other with respect to the flow direction of the external fluid;

an introducing portion connected to a first end of the core portion and in communication with the first passages for introducing the internal fluid in the first passages;

a discharging portion connected to the first end of the core portion and in communication with the second passages for discharging the internal fluid from the second passages;

a collecting portion connected to a second end of the core portion, the collecting portion including a first collecting space and a second collecting space, the first collecting space is in communication with the first passages of the first core section and the second collecting space is in communication with the first passages of the second core section;

a distributing portion connected to the second end of the core portion, the distributing portion including a first distributing space and a second distributing space, the first distributing space is in communication with the second passages of the first core section, and the second distributing space is in communication with the second passages of the second core section; and a communicating part including a first communicating portion and a second communicating portion, wherein the first communicating portion is disposed to allow communication between the first collecting space and the second distributing space, and the second communicating portion is disposed to allow communication between the second collecting space and the first distributing space.

2. The heat exchanger according to claim 1, wherein the tubes are arranged in two rows, the first passages are formed in a first row of tubes and the second passages are formed in a second row of tubes, the first communicating portion and the second communicating portion are disposed to cross each other, thereby to provide an intersectional part.

3. The heat exchanger according to claim 2, wherein the collecting portion and the distributing portion are provided by tank portions, one of the tank portions is arranged downstream of the other with respect to a flow direction of the external fluid, and the tank portions are divided at middle positions thereof and, the communicating part is disposed at the middle positions of the tank portions.

4. The heat exchanger according to claim 2, wherein the collecting portion and the distributing portion are provided by tank portions, one of the tank portions is arranged downstream of the other with respect to a flow direction of the external fluid, and the communicating part is provided outside of the tank portions.

5. The heat exchanger according to claim 2, wherein the collecting portion and the distributing portion are provided by tank portions, one of the tank portions is arranged downstream of the other with respect to a flow direction of the external fluid, the communicating part is provided by a connecting tank member arranged between the tank portions, the connecting tank member is divided into a first space and a second space, the first communicating portion is provided by the first space, and the second communicating portion is provided by the second space.

6. The heat exchanger according to claim 1, wherein the tubes are arranged in two rows, the first passages are formed by a first row of tubes and the second passages are formed by a second row of tubes, the distributing portion forms a first tank portion defining the first space and a second tank portion defining the second space, and one of the first and second tank portions is arranged upstream of the other with respect to a flow direction of the external fluid.

7. The heat exchanger according to claim 6, wherein the collecting portion is divided into the first collecting space and the second collecting space by a separator, the first communicating portion is provided at an end of the collecting portion to allow communication between the first collecting space of the collecting portion and the second tank portion, and the second communicating portion is provided at an opposite end of the collecting portion to allow communication between the second collecting space of the collecting portion and the first tank portion.

8. The heat exchanger according to claim 6, wherein the collecting portion is provided downstream of the first and second tank portions with respect to the flow direction of the external fluid.

9. The heat exchanger according to claim 1, wherein the tubes are arranged in two rows, the first passages are formed in a first row of tubes and the second passages are formed in a second row of tubes, the collecting portion forms a first tank portion defining the first collecting space and a second tank portion defining the second collecting space, and one of the first and second tank portions is arranged upstream of the other with respect to a flow direction of the external fluid.

10. The heat exchanger according to claim 9, wherein the first communicating portion is provided at an end of the distributing portion to allow communication between the second tank portion and the first distributing space of the distributing portion, and the second communicating portion is provided at an opposite end of the distributing portion to allow communication between the first tank portion and the second distributing space of the distributing portion.

11. The heat exchanger according to claim 9, wherein the distributing portion is provided upstream of the first and second tank portions with respect to the flow direction of the external fluid.

12. The heat exchanger according to claim 1, wherein each of the tubes has a flat tube cross-section and defines a plurality of passage spaces therein, and the first passages and the second passages are defined by the passage spaces in the tube.

13. The heat exchanger according to claim 1, wherein the core portion is arranged such that the tubes are layered in a vertical direction.

14. The heat exchanger according to claim 1, further comprising a plurality of inlets through which the internal fluid is introduced in the introducing portion.

15. The heat exchanger according to claim 1, wherein the core portion forms a multi-flow-type core in which the tubes are arranged such that the internal fluid flows in the plurality of tubes at the same time.

16. The heat exchanger according to claim 1, wherein the tubes are in forms of serpentine and the core portion forms a multiple-pass, serpentine-type core.

17. The heat exchanger according to claim 1, wherein the introducing portion, discharging portion, collecting portion and distributing portion are provided by tank portions.

18. The heat exchanger according to claim 17, wherein each of the tank portions is formed of a tank plate forming a groove and a communication plate forming communication holes, and the communication plate is joined to the tank plate.

19. The heat exchanger according to claim 1, wherein the core portion is disposed such that the internal fluid flows in the first passages in an upward direction.

20. The heat exchanger according to claim 1, wherein the internal fluid is refrigerant.

21. A method of using the heat exchanger according to claim 20 in combination with an internal heat exchanger performing heat exchange between a high temperature refrigerant and a low temperature refrigerant.

22. The method according to claim 21, wherein the heat exchanger is used further in combination with an ejector.

23. A method of using the heat exchanger according to claim 20 in a refrigerant cycle in which a gas-liquid separator is arranged upstream of one of a pressure-reducing device and the heat exchanger.

24. The heat exchanger according to claim 1, wherein:

the first collecting space and the second collecting space are disposed in the core width direction; and the first distributing space and the second distributing space are disposed in the core width direction.

* * * * *